US005517207A

United States Patent [19]

Kawada et al.

[11] Patent Number: 5,517,207

[45] Date of Patent: May 14, 1996

[54] METHOD AND A SYSTEM FOR DRIVING A DISPLAY PANEL OF MATRIX TYPE

[75] Inventors: Toyoshi Kawada, Atsugi; Tetsuya Kobayashi, Hadano; Hisashi Yamaguchi, Atsugi; Tetsuo Aoki, Kawasaki; Hiroyuki Miyata, Akashi, all of Japan

[73] Assignee: Fujitsu Limited, Kawasaki, Japan

[21] Appl. No.: 301,436

[22] Filed: Sep. 8, 1994

Related U.S. Application Data

[63] Continuation of Ser. No. 29,994, Mar. 8, 1993, abandoned, which is a continuation of Ser. No. 501,326, Mar. 29, 1990, abandoned, which is a continuation of Ser. No. 60,017, Jun. 9, 1987, abandoned.

[30] Foreign Application Priority Data

| | | | |
|---|---|---|---|
| Jun. 17, 1986 | [JP] | Japan | 61-142265 |
| Sep. 11, 1986 | [JP] | Japan | 61-215271 |
| Mar. 28, 1987 | [JP] | Japan | 62-073027 |

[51] Int. Cl.[6] ..... G09G 3/30

[52] U.S. Cl. ..... 345/78; 345/79; 345/209

[58] Field of Search ..... 345/76–80, 209; 315/169.3

[56] References Cited

U.S. PATENT DOCUMENTS

| | | | |
|---|---|---|---|
| 4,152,626 | 5/1979 | Hatta et al. | 340/805 |
| 4,479,120 | 10/1984 | Ohba et al. | 340/781 |
| 4,485,379 | 11/1984 | Kinoshita et al. | 340/781 |
| 4,523,189 | 6/1985 | Takahara et al. | 340/781 |
| 4,594,589 | 6/1986 | Ohby et al. | 340/805 |
| 4,595,919 | 6/1986 | Holz et al. | 340/805 |
| 4,636,789 | 1/1987 | Yamaguchi et al. | 340/781 |
| 4,652,872 | 3/1987 | Fujita | 340/781 |
| 4,691,144 | 9/1987 | King et al. | 340/781 |
| 4,733,228 | 3/1988 | Flegal | 340/781 |
| 4,962,374 | 10/1990 | Fujioka et al. | 340/781 |

FOREIGN PATENT DOCUMENTS

| | | |
|---|---|---|
| 0106550 | 4/1984 | European Pat. Off. . |
| 2739675 | 3/1978 | Germany . |
| 3205653 | 8/1982 | Germany . |
| 3232389 | 3/1983 | Germany . |
| 2086634A | 5/1982 | United Kingdom . |
| 33/03021 | 9/1983 | WIPO . |

OTHER PUBLICATIONS

Kawada T. et al., "A Symmetric Drive with Low Voltage Drivers for ac TFEL", Fujitsu Laboratories Ltd., Atsugi, Kanagawa, *Japan Display*, 1986, pp. 772–275.

*Primary Examiner*—Richard Hjerpe
*Assistant Examiner*—Steven J. Saras
*Attorney, Agent, or Firm*—Staas & Halsey

[57] ABSTRACT

A method and a system for driving an electro-luminescence display panel of a matrix type has a compensation pulse applied to all the cells prior to or in the front of a pedestal pulse on every frame cycle. The level of the compensation pulse is higher than the pedestal pulse but low enough not to light the cells by itself. The duration of the compensation pulse is long enough to saturate charge polarization in the EL material of the cell, as a dielectric, at the applied voltage. Therefore, brightness of the lighted cell is kept constant regardless of the number of lighted cells on the same data electrode. Each of two power-receiving terminals of push-pull scan drivers is connected to a pulse generator respectively. One of the two power-receiving terminals may be floated from the pulse generator while data pulse is applied to the data electrodes. This configuration prevents damage of the CMOS drivers by latch-up caused therein, as well as reducing power consumption produced by charging current of the data pulses into non-lighted cells.

35 Claims, 11 Drawing Sheets

FIG. 1(a)
PRIOR ART
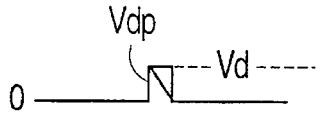
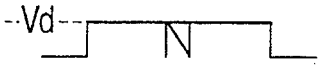
FIG. 1'(a)
PRIOR ART
FIG. 1(b)
PRIOR ART
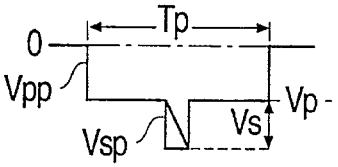
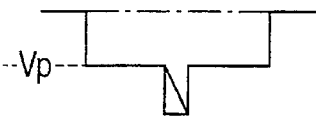
FIG. 1'(b)
PRIOR ART
FIG. 1(c)
PRIOR ART
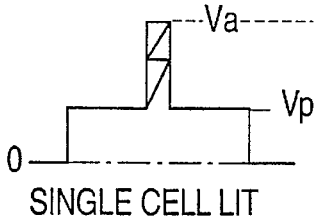
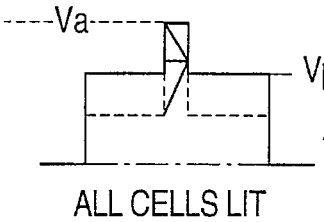
FIG. 1'(c)
PRIOR ART
FIG. 2(a)
PRIOR ART
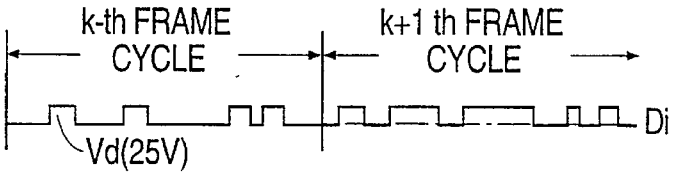
FIG. 2(b)
PRIOR ART
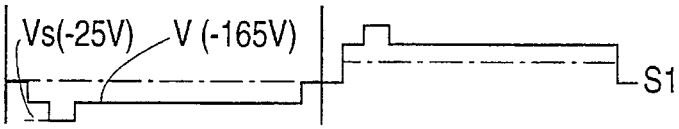
FIG. 2(c)
PRIOR ART
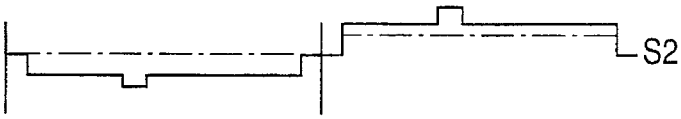
FIG. 2(d)
PRIOR ART
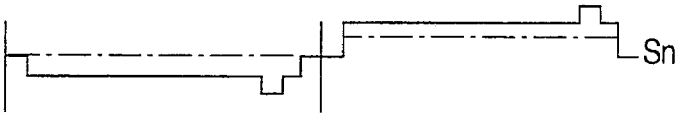
FIG. 2(e)
PRIOR ART
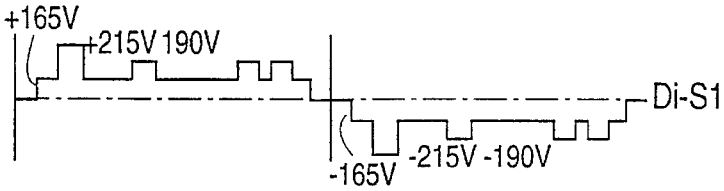
FIG. 2(f)
PRIOR ART
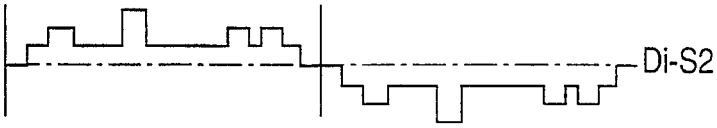
FIG. 2(g)
PRIOR ART
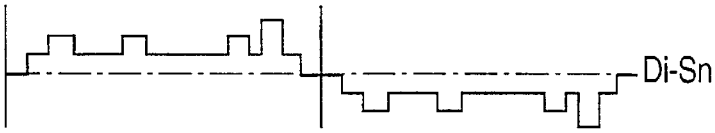

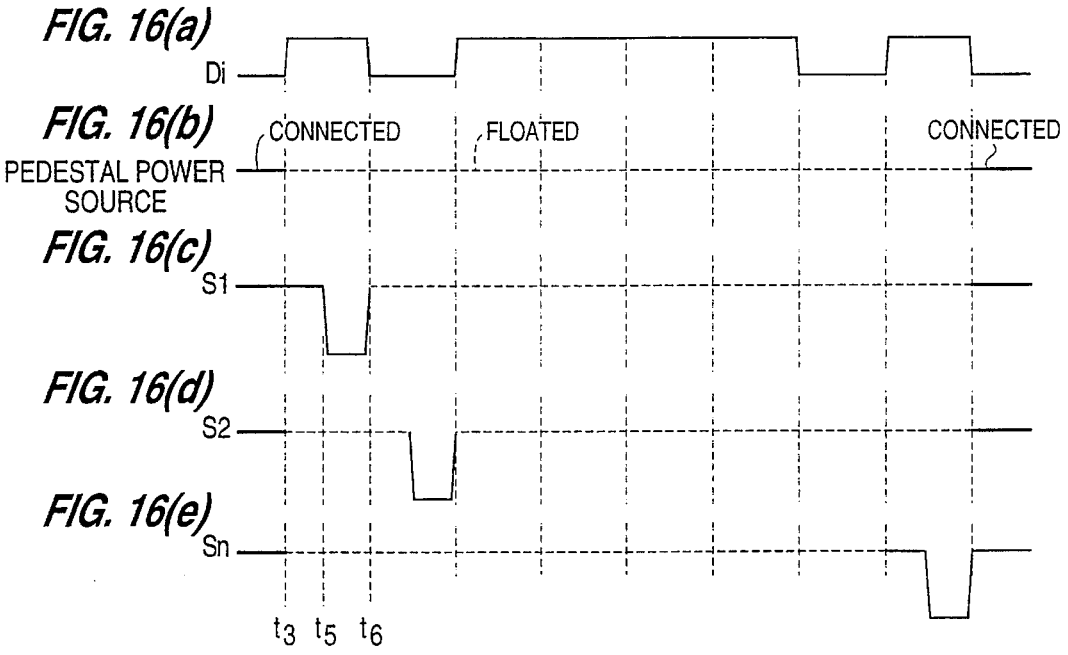
FIG. 16(a)
Di
FIG. 16(b)
CONNECTED
FLOATED
CONNECTED
PEDESTAL POWER SOURCE
FIG. 16(c)
S1
FIG. 16(d)
S2
FIG. 16(e)
Sn
t3 t5 t6
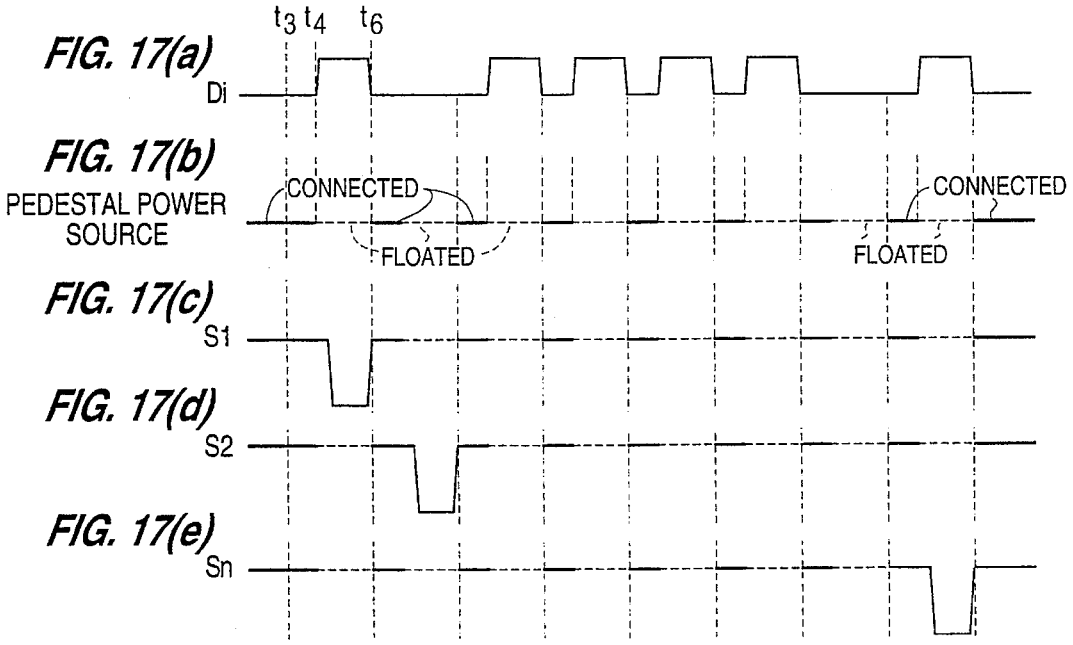
t3 t4 t6
FIG. 17(a)
Di
FIG. 17(b)
CONNECTED
CONNECTED
PEDESTAL POWER SOURCE
FLOATED
FLOATED
FIG. 17(c)
S1
FIG. 17(d)
S2
FIG. 17(e)
Sn

METHOD AND A SYSTEM FOR DRIVING A DISPLAY PANEL OF MATRIX TYPE

This application is a continuation of application Ser. No. 08/029,994, filed Mar. 8, 1993, now abandoned, which is a continuation of application Ser. No. 07/501,326, filed Mar. 29, 1990, now abandoned, which is a continuation of application Ser. No. 07/060,017, filed May 9, 1987, now abandoned.

BACKGROUND OF THE INVENTION

1. Field of the Invention

This invention relates to a method for driving an electrically luminous material, such as so-called electroluminescence (referred to hereinafter as EL) display panel of a matrix type, particularly in which a scan electrode of a matrix type display panel is driven by a pulse which is composed of a pedestal pulse and a scan pulse. More particularly, it relates to an improvement for achieving uniformity of brightness all over the panel.

2. Description of the Related Art

As is well known, in a matrix type EL display panel, an EL cell located at an intersection of a scan electrode and a data electrode is selectively lit by application of a pulse voltage on the scan electrode, as well as by simultaneous application of a data pulse voltage, on a data electrode, having a polarity opposite to that of the scan pulse. The applied pulse voltage between the scan and the data electrodes is the sum of the respective absolute values of the scan pulse voltage and data pulse voltage, and is called a cell voltage. Polarity of the cell voltage is generally altered with every frame cycle in order to attain brighter light output as well as normal operation of the EL cell. Furthermore, in order to lower the voltage rating of the scan driver, the scan pulse is composed of a pedestal pulse whose duration is approximately 15.0 ms, for example, for the frame cycle time 16.7 ms of 60 frames per second, and an additional scan pulse of 25 to 30 μs, for example, for 400 scan electrodes. The pedestal pulse has been popularly employed for driving a PDP (plasma display panel), and it is also disclosed in the International Publication Number of PCT: WO 83/03021 by HARJU, Terho, Teuvo. FIG. 1(*a*) illustrates a waveform of a data electrode, where $V_{dp}$ indicates a data pulse having a positive voltage Vd, and having a pulse width basically the same as that of the scan pulse, thus, a single cell at the center of a data electrode is lit. FIG. 1(*b*) illustrates a waveform of a scan electrode, where $V_{pp}$ indicates a pedestal pulse having a negative voltage $-V_p$ and the pulse width $T_p$. $V_{sp}$ indicates a scan pulse having a negative voltage −Vs superposed on the negative pedestal pulse $V_{pp}$. Thus, when a scan electrode is selected, the total scan pulse voltage Vp+Vs, a so-called half-selective voltage, is applied thereto. The level of the individual pulse Vd or Vp+Vs is chosen not adequate to light the cell by itself. FIG. 1(*c*) illustrates a wave form of a cell voltage of the cell to which the above-mentioned data pulse and scan pulse are applied, measured with reference to the scan electrode. The peak level Va, which is the sum of the absolute values of Vd, Vp and Vs, is chosen high enough to light the cell, such as 215 V, thus this peaked pulse is called a write pulse. With this constitution of these driving pulses, the scan driver which is composed of an integrated circuit (IC) has to only switch a low voltage Vs, such as 25 V, which, in other words, is the difference between the half-selective pulse voltage 190 V and the pedestal pulse level 165 V, therefore is much less than the total scan voltage, 190 V. Timing charts of these pulses are shown in FIG. 2, where n scan electrodes are provided. FIG. 2(*a*) shows the waveform of the i-th data electrode. FIG. 2(*b*) through (d) show respective waveforms of the scan electrodes $S_1$ through $S_n$. FIG. 2(*e*) through (g) show respective waveforms of the cell voltage at intersections of the i-th data electrode and respective scan electrodes $S_1$ through $S_n$. Generally the data electrodes $D_1$ through $D_m$ are driven in parallel by the data driver 6-1 through 6-m. Therefore, the frame cycle time $T_f$ is the time required to scan all the scan electrodes (as many as n) and then to return to the first scan electrode for the next frame cycle. During the next (i.e. k+1 th) frame cycle, the pedestal pulse is generally reversed and the level is +190 V, whose absolute value is different from that of the previous frame cycle, because the data electrode is biased at a high level (+25 V) to deliver a data pulse of 0 V to the data electrodes. Thus, a write pulse of the same height as that of the previous cycle is produced.

A typical scan pulse generator/driver for delivering the pulses is shown in FIG. 3, as quoted in the above-mentioned patent application. However, in this method employing the pedestal pulse, there is a problem in that the brightness of a particular lighted cell varies depending on the number of the lighted cells connected to the same data electrode through a frame cycle. Description regarding this problem hereinafter is made for a still picture, where the data pulses are same for every frame cycle, in order to simplify the explanation. FIG. 1' illustrate an extreme case, where all the cells on a data electrode are lit, in comparison with FIG. 1 where a single cell on a data electrode is lit. As observed in FIG. 1'(*c*), the pedestal pulse level becomes virtually Vp+ Vd, because data pulses for lighting all the cells are continuously superposed on the pedestal level. Brightness characteristics of these two cases depending on the virtual pedestal level are shown in FIG. 4, where the level of the write pulse is variable. The curve "b" is of the case having a 165 V pedestal pulse to simulate the single lighted cell of FIG. 1, and curve "c" is of the case having a 190 V pedestal pulse to simulate the all-lighted cells of FIG. 1'. The brightness of the curve "c" is obviously lower than that of the curve "b". Brightness characteristics of the case where the number of the lit cells is between "a single cell" and "all cells" must come to between the curve "b" and "c". In order to simulate this state, curve "d" of FIG. 6 is obtained by measuring a sample EL panel. In FIG. 6, the pedestal voltage is variable while the write pulse and the data pulse are kept constant, respectively 240 V and 25 V. Accordingly "the pedestal pulse voltage+the scan pulse voltage" is kept constant. As observed with the curve "d" the brightness decreases as the virtual pedestal voltage is increased over 150 V. This means that the brightness decreases as the number of the lit cells on a data line increases. As is well known, when the EL material produces a light by a write pulse, electrical charges in the EL material, as a dielectric material, are displaced by the applied electric field causing a charge polarization.

The mechanism of this phenomena is hereinafter explained. Brightness of the produced light of a cell depends on the amount of the produced polarization charge therein. The relation between the applied pulse and the produced polarization charges in the cell was investigated and is shown in FIG. 7. The solid lines show the case where a single cell on a data electrode is lit, and the dotted lines show the case where all the cells on a data electrode is lit. The timing when the pedestal pulse is applied to the scan electrode is indicated by "tp", and the timing when the write pulse is applied to the electrodes is indicated by "tw". The polarization charge remaining before tp is the residual charge of the previous frame cycle, during which the polarity of the cell voltage was reversed. The increment of the charge curve "f" of the low pedestal level ("a single lit cell") at tw is larger than that at tp. The word "increment" used above as well as hereinafter means the difference of the charge between before and after the application of a pulse voltage; and the word "difference" includes not only the difference in a particular polarity of the charge but also the charge difference from the plus charge to the negative charge and vice versa. However, the increment of the curve "g" of the high pedestal level ("all the lit cells") at tw is smaller than that at tp. Furthermore, over the all increment Qb (0.38 μ coulomb/$cm^2$) of the curve "g", is smaller than the over all increment Qa (0.48 μ coulomb/$cm^2$) of the curve "f". This data means that the difference of the virtual pedestal level gives effect on the charge increment at tp as well as over all increment, accordingly causing the deterioration of the brightness characteristics.

SUMMARY OF THE INVENTION

It is an object of the invention, therefore to provide an improved method of achieving uniform brightness of a lighted cell regardless of the number of lighted cells on the same data electrode during a frame cycle.

According to the method of the invention, a compensation pulse is applied to all the cells prior to the application of a pedestal pulse thereto. For each frame cycle, polarity of the compensation pulse is the same as that of the pedestal pulse. Level of the compensation pulse is higher than the pedestal pulse, or usually almost equal to the sum of the pedestal pulse and the data pulse, but not high enough to light a cell by itself. Duration of the compensation pulse is long enough to saturate charge polarization corresponding to the level of the applied compensation pulse. Any half selective pulse applied to a cell during a frame cycle does not affect this polarization charge produced by the compensation pulse. Therefore, the increment of the polarization charge produced by an application of a write pulse voltage is uniform regardless of the number of the half selective pulses in a frame cycle, thus allowing the fully selected cell to produce a light of constant brightness.

The above-mentioned features and advantages of the present invention, together with other objects and advantages, which will become apparent, will be more fully described hereinafter, reference being had to the accompanying drawings forming a part hereof, wherein like numerals refer to like parts throughout.

BRIEF DESCRIPTION OF THE DRAWINGS

FIG. 1 illustrate the performance of a pedestal pulse having a single lighted cell on a data electrode.

FIG. 1' illustrate the performance of a pedestal pulse having all-lighted cells on a data electrode.

FIG. 2 illustrate a timing chart of applied pulses of the prior art.

FIG. 16 illustrate timing charts showing the floating of the power-receiving terminal and the applied pulses.

FIG. 17 illustrate another timing chart showing the floating of the power-receiving terminal and the applied pulses.

DESCRIPTION OF THE PREFERRED EMBODIMENTS

The following description is made, with reference to a case where a still picture is displayed, i.e. the applied data pulses are constant through every frame cycle.

Figure 6:
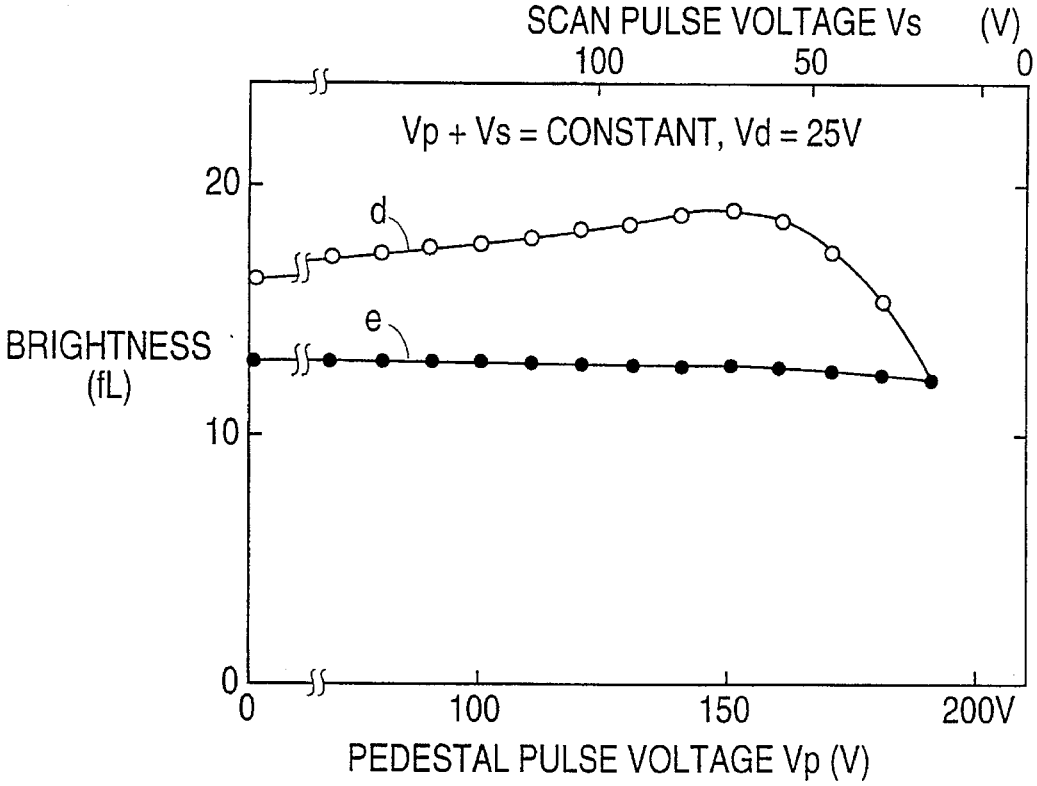
FIG. 6 illustrates brightness vs. virtual pedestal voltage.
Figure 8A:
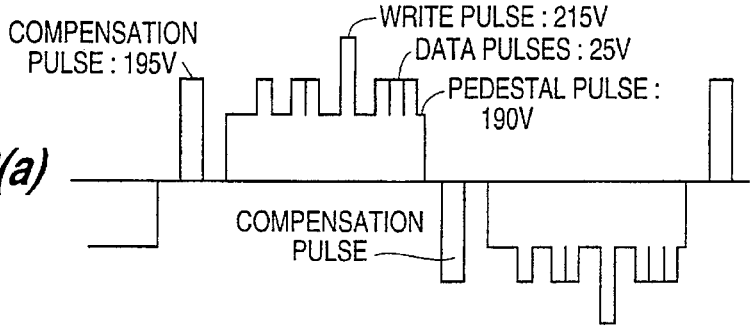
FIG. 8 illustrate the compensation pulses according to the present invention.
Figure 8B:
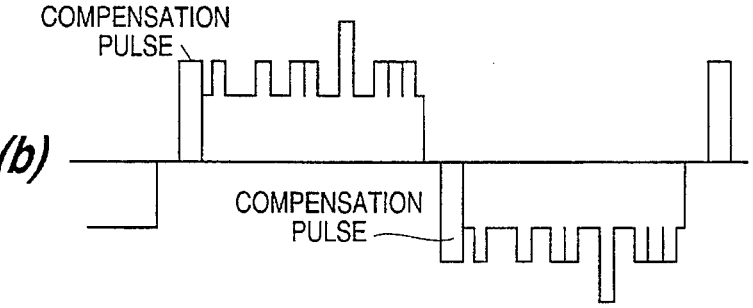
Figure 11A:
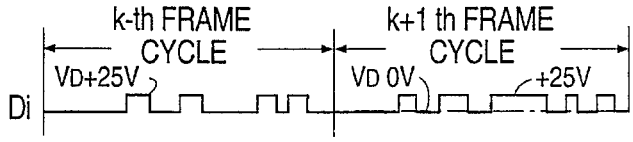
FIG. 11 illustrate timing charts of the applied pulses according to the present invention.
Figure 11B:
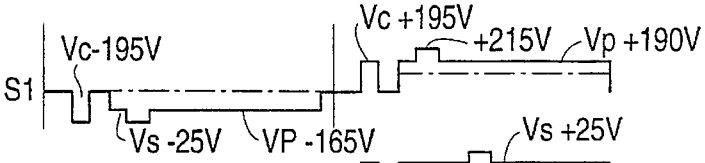
Figure 11C:
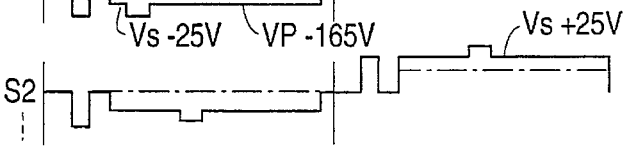
Figure 11D:
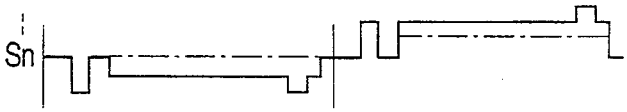
Figure 11E:
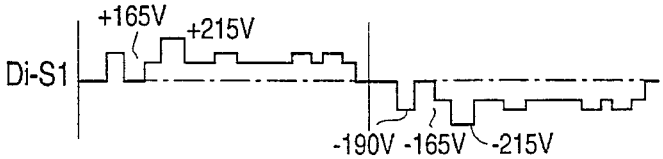
Figure 11F:
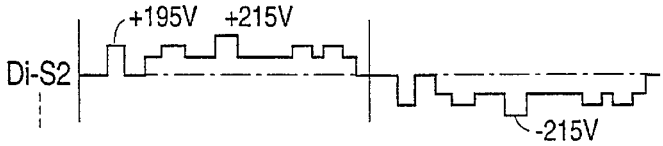
Figure 11G:
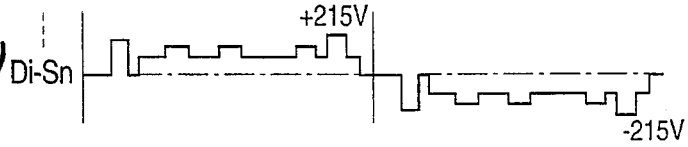

A waveform of a cell voltage according to the present invention is shown in FIGS. 8(*a*) and 8(*b*). According to the present embodiment of the invention, the pedestal pulse voltage Vp is 165 V, the scan pulse voltage Vsp is 25 V and the data pulse voltage Vd is 25 V, therefore, the level of the compensation pulse is chosen 195 V, a little higher than the half-selective pulse level, 190 V, which is the sum of the pedestal pulse voltage Vp and the data pulse voltage Vd, but lower than a level at which the cell starts to produce a light. The compensation pulse thus having 195 v is applied to the cell prior to the pedestal pulse on the same polarity as that of the pedestal pulse, and of course lower than the write pulse voltage, 215 V. Some of these voltage values are different from those referred to for the sample panel used for FIG. 6, because data are from a practical panel in production. In the second frame cycle, the polarity of the compensation pulse is reversed together with the pedestal pulse. The compensation pulse is applied prior to the front edge of the pedestal pulse, leaving a time interval as shown in FIG. 8(*a*), however, the compensation pulse may contact the front edge of the pedestal pulse as shown in FIG. 8(*b*). Duration of the compensation pulse is approximately 1 ms, which is sufficiently longer than the approximately 0.5 ms required to saturate polarization of the electric charges in the EL material, as a dielectrics, of the cell. Therefore, any half-selective pulse, i.e. "the pedestal pulse+the data pulse" applied to the cell during a frame cycle does not effect the polarization charges produced by the compensation pulse. Then, a write pulse, i.e. a fully selective pulse, having a voltage level 215 V, is applied to the cell. Accordingly, the write pulse produces an essentially constant increment of the polarization charge additionally in the EL material of the cell, at this time, the cell simultaneously produces light depending on the amount of the increment of the polarization charge. Due to this essentially constant increment of the polarization charge, the brightness of the produced light is essentially constant regardless of the number of the half-selective pulses applied to the cell, i.e. the number of the data pulses during a frame cycle.

Figure 7:
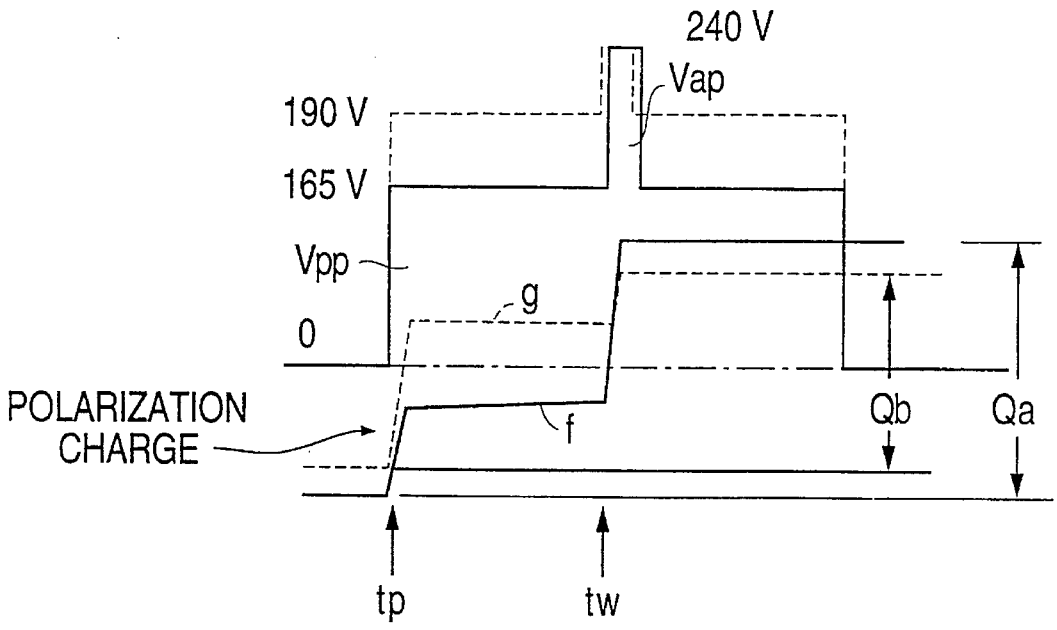
FIG. 7 PRIOR ART
FIG. 7 illustrates polarization charge in a cell of the prior art.
Figure 9:
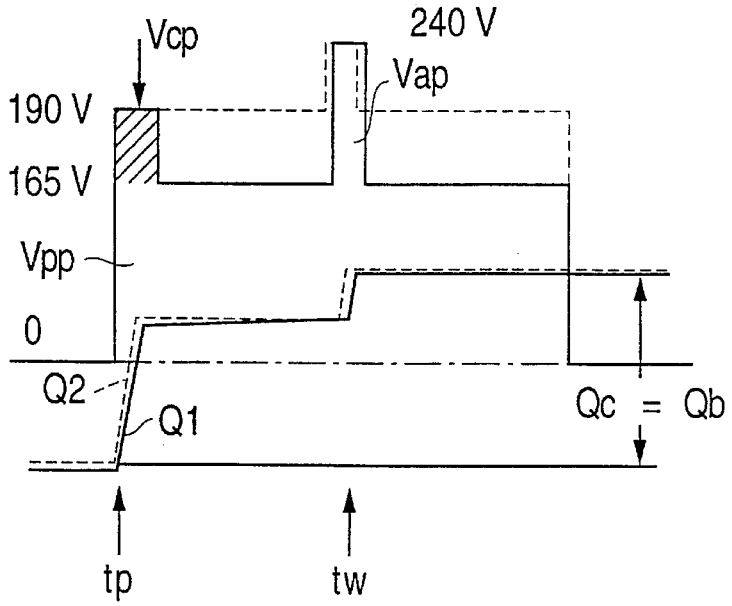
FIG. 9 illustrates polarization charge in a cell according to the present invention.

The above-described effect of the compensation pulse on the polarization charge is further explained in FIG. 9, where the solid lines as well as dotted lines are designating the same as those used in FIG. 7. The charge increments shown by the solid line as well as dotted line at tp indicate the same values. The over all increments Qc after application of the compensation pulse is equal to Qb (0.38 μ coulomb/$cm^2$). The result of employing the compensation pulse is shown by the curve "e" in FIG. 6, where all the conditions are kept the same as those for the curve "d" of the prior art, except the application of the compensation pulse of the present invention. As observed in the figure, the brightness of the lighted cell is almost constant when the pedestal voltage varies, even though the maximum value of the brightness is somewhat reduced. The compensation pulse may be either independent as shown in FIG. 8(*a*) or superposed on the pedestal pulse as shown in FIG. 8(*b*). The above-mentioned matters of the present invention are also disclosed in "Proceedings of the 6th International Display Research Conference. Oct. 1, 1986" titled as "A Symmetric Drive with Low Voltage Drivers for ac TFEL" by the present inventors.

Figure 10:
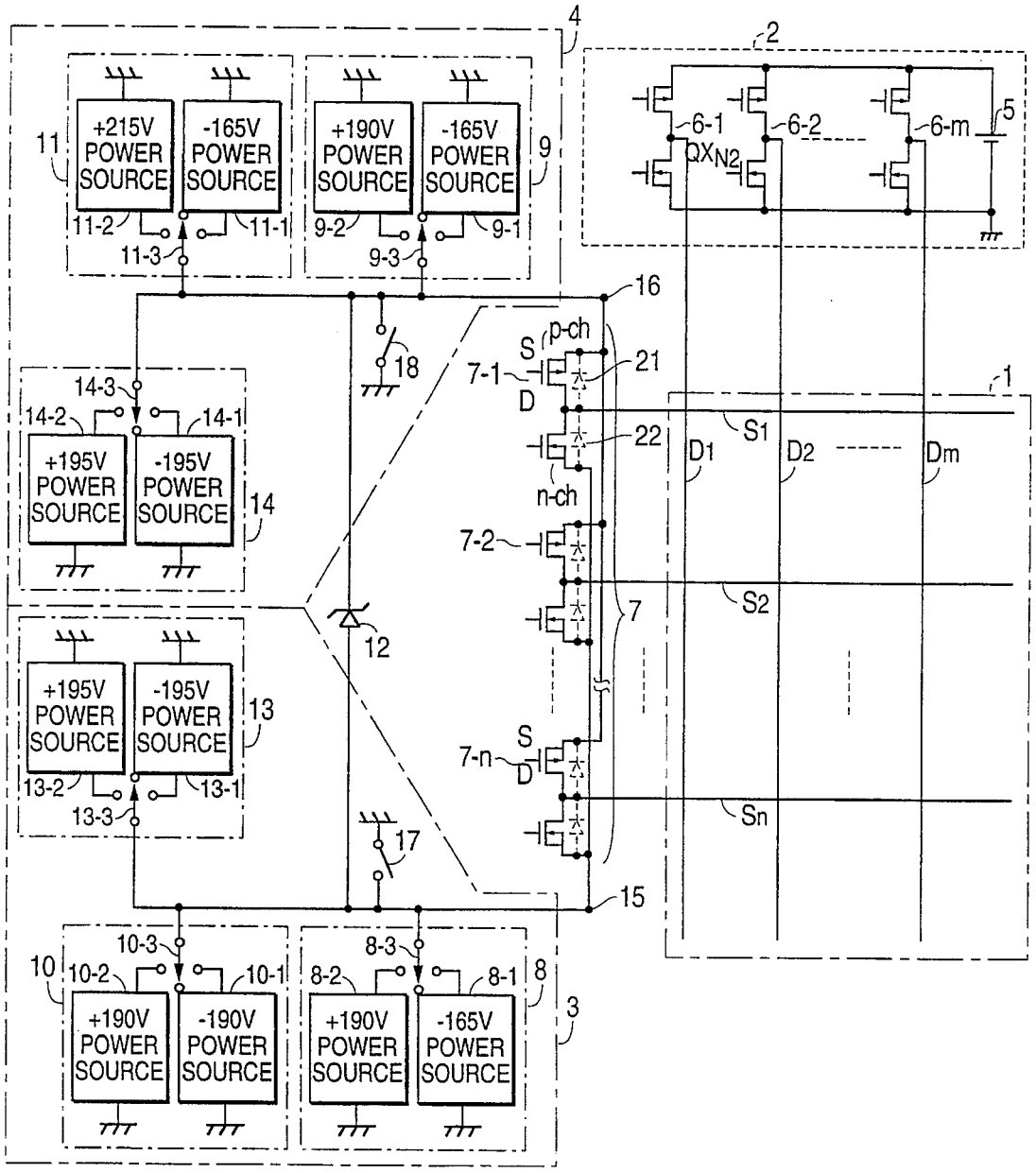
FIG. 10 schematically illustrates a circuit diagram for producing pulses according to the present invention.

A block circuit diagram for explaining the supply of the driving pulses including the compensation pulse of the present invention is shown in FIG. 10. The numeral 1 denotes an EL panel, on which m electrodes, $D_1$ through $D_m$, generally made of a transparent material, such as ITO (indium tin oxide), and n scan electrodes, $S_1$ through $S_n$, generally made of aluminum, are arranged orthogonally to each other. The numeral 2 denotes a data pulse generator/driver in which m pairs of single-ended push-pull drivers, 6-1 through 6-m are provided as switching elements. Each is composed of a p-channel MOS transistor and an n-channel MOS transistor. A DC power source 5 (+25 V), is included. Commonly connected drains of both transistors in a single-ended push-pull driver provide an output terminal, which is connected to each corresponding data electrode. Scan drivers 7 are composed of n pairs of CMOS single-ended push-pull drivers 7-1 through 7-n, as switching elements. Each CMOS driver includes a p-channel MOS transistor and an n-channel MOS transistor therein. Commonly connected drains of both transistors in a CMOS single-ended push-pull driver provide an output terminal and are connected to each corresponding scan electrode. Between the drain and source of each transistor of the CMOS driver, a natural diode (a parasitic diode) 21 or 22 exists as shown by dotted lines in the figure, so as to bypass a current in the reverse direction to the conduction through each associated transistor. All the sources of the n-channel transistors are commonly connected to a power-receiving terminal 15. All the sources of the p-channel transistors are commonly connected to a power-receiving terminal 16. The first driving pulse generator 3 is connected to the terminal 15. The first driving pulse generator 3 is composed of a first pedestal pulse generator 8, a first scan pulse generator 10, and a first compensation pulse generator 13 and a ground switch 17. The first pedestal pulse generator 8 is composed of a negative DC power source (−165 V) 8-1, a positive DC power source (+190 V) 8-2 and a three-position switch 8-3 which selectively connects the power source 8-1 or 8-2 to the terminal 15. The first scan pulse generator 10 is composed of a negative DC power source (−190 V) 10-1 and a positive DC power source (+190 V) 10-2 and a three-position switch 10-3 which selectively connects the power source 10-1 or 10-2 to the terminal 15. The first compensation pulse generator 13 is composed of a negative DC power source (−195 V) 13-1 and a positive DC power source (+195 V) 13-2, and a three-position switch 13-3 which selectively connects the power source 13-1 or 13-2 to the terminal 15. A second driving pulse generator 4 is connected to the terminal 16. The second driving pulse generator 4 is composed of a second pedestal pulse generator 9, the second scan pulse generator 11, a second compensation pulse generator 14 and a ground switch 18. The second pedestal pulse generator 9 is composed of a negative DC power source (−165 V) 9-1, a positive DC power source (+190 V) 9-2 and a three-position switch 9-3 which selectively connects the power source 9-1 or 9-2 to the terminal 16. The second scan pulse generator 11 is composed of a negative DC power source (−165 V) 11-1, a positive DC power source (+215 V) 11-2 and a three-position switch 11-3 which selectively connects the power source 11-1 or 11-2 to the terminal 16. The second compensation pulse generator 14 is composed of a negative DC power source (−195 V) 14-1, a positive DC power source (+195 V) 14-2, and a three-position switch 14-3 which selectively connects the power source 14-1 or 14-2 to the terminal 16. Each of the above-mentioned three-position switches has a center position, which is connected to nothing, i.e. a floating position or an open position. Between the terminal 15 and 16, a zener diode 12 is connected, whose anode is connected to the terminal 15 and the cathode to 16. Each terminal opposite to the output terminal of each DC power source mentioned above is grounded.

A manner to apply the driving pulses to the electrodes of the cells is hereinafter described, referring to FIG. 10 and FIG. 11, timing charts. It is normal for the data pulse generator/driver 2 to drive all the data electrodes, $D_1$ through $D_m$, in parallel. FIG. 11(*a*) shows a pulse voltage form applied to the data electrode $D_i$ waveform a data pulse driver 6-i. FIGS. 11(*b*) through 11(*d*) show pulse voltage waveforms applied to the scan electrodes $S_1$ through $S_n$ respectively from the scan pulse driver 7-1 through 7-n. FIGS. 11(*e*) through 11(*g*) show the cell voltage waveforms measured with reference to the scan electrode. The previous (k-l th) scan cycle (not shown in the figure) during which the applied cell voltage was negative is finished and the cell voltage is to be positive for the k-th scan cycle. Then, driven by control signals (not shown in the figure), such as an enable signal, etc., the switch 13-3 and 14-3 are connected to the power source 13-1 and 14-1 respectively, while all other switches are kept at the central position or open. Thus, −195 V is applied to the terminal 15 as well as 16. Consequently, all the scan electrodes are charged at −195 V through each diode 21 and 22, thus, the positive compensation pulse voltage, +190 V, is applied to the cells. After approximately 1 ms of application of the compensation voltage, the switches 13-3 and 14-3 are opened, and the ground switch 17 and 18 are closed so as to return the terminal 15 and 16 to 0 V. During application of this compensation pulse, all the data electrodes $D_1$ through $D_m$ are kept at 0 V by the push-pull driver 6-1 through 6-m switched by control signals (not shown in the figure) applied to the gates of the respective push-pull drivers. Variation of the circuit for supplying the compensation pulse shall be described after the description of the operation of the circuit of FIG. 10.

After the compensation pulse, cells are driven as described below. After the ground switches 17 and 18 are opened, the switches 8-3 and 9-3 are respectively switched to the pedestal power source 8-1 and 9-1 having −165 V, while the data drivers deliver 0 V to all the data electrodes. Then all the scan electrodes are charged through each diode 21 and 22 at −165 V, thus the positive pedestal pulse voltage, +165 V, is applied to the cells. Timing of switching-on the switches 8-3 and 9-3 may be either at the time of, or later than the end of the compensation pulse as shown in FIG. 8(*a*) or (*b*).

In order to select the first scan electrode $S_1$, the switches 10-3 and 11-3 are switched to the power source 10-1 having −190 V and 11-1 having −165 V respectively, while all the other switches 8-3, 9-3, 13-3, 14-3, 17 and 18 are kept open (neutral). At this time, the potential difference between the terminal 15 and 16 is 25 V, so the scan drivers 7 have only to switch as low as 25 V. And the first n-ch transistor is switched conductive, while the paired p-ch transistor is kept non-conductive but all other p-ch transistors in the scan drivers 7 are kept conductive, as well as all other n-ch transistors in the scan drivers 7-2 through 7-n are kept non-conductive, all controlled by control signals (not shown in the figure) applied to the gates of the transistors. Thus, the total scan voltage, −190 V, which is a half selective voltage, is selectively applied to the first scan electrode $S_1$, and −165 V is applied to all other scan electrodes, as shown by the wave form FIG. 11(*b*). After approximately 25 μs of holding this state, the scan driver 7-1 is switched causing conducting by the p-ch transistor as well as non-conducting by the n-ch transistor so as to deliver −165 V to the first scan electrode, then the second scan electrode $S_2$ is selectively applied with the −190 V in the same manner as those for selecting the first scan electrode, and repeated sequentially for the following scan electrodes, as shown by the waveforms of FIGS. 11(*c*) and 11(*d*).

Driving of the data electrodes is as described below. For lighting cells on the i-th data electrode $D_i$, a push-pull driver connected to the data electrode $D_i$ is selectively switched by control signals (not shown in the figure) applied to each gate thereof so as to deliver a +25 V pulse to the data electrode $D_i$, essentially synchronized with the application of the half selective −190 V onto a corresponding scan electrode where the cell is to be lit, as shown by FIG. 11(*a*). At this time, as shown in FIGS. 11(*e*) through 11(*g*) , the cell voltage becomes as high as +215 V, which is called "fully selective" or a write pulse, and is high enough to light the cell. After the final scan electrode is selected, the pedestal pulse is terminated, and then, in general, refresh pulses may be applied thereto, so that the total brightness of the cell during a frame cycle is enhanced, but further explanation as well as waveforms in the figure is not given hereinafter.

After finishing this k-th frame cycle, getting into the next (k+1 th) frame cycle, the polarity of the cell voltage is reversed. Driven by control signals (not shown in the figure), such as enable signal, etc., the switches 13-3 and 14-3 are connected to the power source 13-2 and 14-2 respectively, while all other switches are kept neutral or open. Thus, +195 V is applied to the terminal 15 as well as 16, while the data drivers 6-1 through 6-m deliver 0 V to all the data electrodes $D_1$ through $D_m$. Therefore, all the scan electrodes are charged at +195 V through each diode 21 and 22, thus the negative compensation voltage, −195 V, is applied to the cells. After approximately 1 ms of the application of the compensation pulse voltage, the power source 13-2 and 14-2 are disconnected to return the terminal 16 to 0 V by closing the ground switch 17 and 18. In order to supply the pedestal pulse, the switches 8-3 and 9-3 are switched to the pedestal power source 8-2 and 9-2 respectively, both having +190 V. Thus all the scan electrodes are charged at +190 V through the diodes 21 and 22.

In order to select the first scan electrode $S_1$, the switches 10-3 and 11-3 are switched to the power source 10-2 having +190 V and 11-2 having +215 V, respectively, while all other switch 8-3, 9-3, 13-3, 14-3, 17 and 18 are kept open (neutral). At this time, the potential difference between the terminal 15 and 16 is 25 V, so the scan driver 7 has only to switch as low as 25 V. The p-ch transistor of the first scan driver 7-1 is switched to be conductive, while the paired n-ch transistor are kept non-conductive and all other n-ch transistors in the scan driver 7 are kept conductive, as well as all other p-ch transistors in the scan driver 7 are kept non-conductive, with all controlled by control signals (not shown in the figure) applied to the gates of the transistors. Thus +215 V is selectively applied to the first scan electrode $S_1$, and +190 V is applied to all other scan electrodes, as shown in FIGS. 11(*b*) though 11(*d*). After approximately 25 μs of holding this state, the second scan electrode $S_2$ and so on is sequentially selected and applied with +215 V.

Driving of the data electrodes is as described below. Because the data signal is by a negative pulse during the k+1 th frame cycle, the data electrodes are biased at +25 V by causing conducting by all the p-ch transistors of the data drivers 6, then cell voltage is 25 V−215 V=−190 V, which is half selective. For lighting cells on the i-th data electrode $D_i$, the push-pull driver connected to the data line $D_i$ is selectively switched by control signals (not shown in the figure) so as to deliver 0 V pulse to the data line $D_i$, as shown by FIG. 11(*a*), essentially synchronized with the above-described application of the +215 V pulse onto a corresponding scan electrode where the cell is to be lit. Then, as shown in FIGS. 11(*e*) through 11(*g*), the cell voltage becomes −215 V, high enough to light the cell. During the k-th frame cycle, though the power sources 13-1 and 14-1 for compensation pulse, or 8-1 and 9-1 for pedestal pulse, each pair having the voltage are simultaneously connected to the both terminals 15 and 16 respectively in the above-described embodiment, this connection of the power sources 13-1 and/or 8-1 may be omitted. The advantage of using two pulse generators (3 and 4, or 3' and 4') having the same voltage is that a deformation of the pulse shape caused by ringing etc. can be prevented by clamping the terminals 15 and 16 with both pulse generators. Not only omitting the connection of one of the pulse generators as above-described, but also the pulse generator itself can be omitted. The above-described method of the configuration of FIG. 10 or 12 may be applied to a case where the pedestal voltage is very low or zero, as long as the driver circuit can withstand the voltage. A similar manner of pulse application may be done, during the k+1 th frame cycle also.

Referring FIGS. 12 and 13, a variation of the driving pulse generator/driver for supplying the compensation pulse as well as driving pulses is hereinafter described. Instead of a ±195 V compensation pulse in the embodiment shown in FIG. 10, the level of the compensation pulse may be chosen 190 V which is equal to the half selective voltage, i.e. pedestal pulse+the data pulse, where the configuration of the pulse driving circuits shown in FIG. 12 may be used. In the figure, the same reference numerals designate the same parts as those in FIG. 10. The first driving pulse generator 3' connected to the common power-receiving terminal 15 is composed of DC power sources $V_{31}$, $V_{32}$, and $V_{33}$ each outputting +190 V, −190 V, −165 V, and series switches 31-1, 32-1, 33-1 which respectively connect the associated DC power sources in a pulsed manner to the terminal 15, and a ground switch 17. The second driving pulse generator 4' connected to the common power-receiving terminal 16 is composed of power sources $V_{41}$, $V_{42}$, and $V_{43}$ each outputting +215 V, +190 V, −165 V, and series switches 41-1, 42-1, 43-1 which respectively connect the associate DC power sources in a pulsed manner to the terminal 16, and a ground switch 18. FIG. 13(*a*) illustrates the voltage waveform of the i-th data electrode. FIGS. 13(*b*) through 13(*d*) illustrate the voltage waveforms of the scan electrodes $S_1$ through $S_n$. FIGS. 13(*e*) through 13(*g*) illustrate the voltage waveforms of the cell voltages of the cells $D_i$-$S_1$ through $D_i$-$S_n$. For the k-th frame cycle, onto all the scan electrodes the pedestal voltage −165 V is supplied through the diodes 21 at the time $t_1$ by closing the switch 43-1 as well as 33-1 (but 33-1 may not be used, as described in the description of operation of the circuits of FIG. 10) while all other switches in the driving pulse generators 3' and 4' are kept open. At the same time $t_1$, onto all the data electrodes, $D_1$ through $D_m$, +25 V of the power source 5 of the data pulse generator/driver 2 is applied by the p-ch transistors, $QX_{pl}$ through $QX_{pm}$, of the data drivers 6-1 through 6-m, while all the n-ch transistors, $QX_{nl}$ through $QX_{nm}$, are kept non-conductive. Therefore, the cell voltage is 190 V = 165 V + 25 V. Thus, the positive compensation pulse voltage is applied to all the cells. At the time $t_2$, after holding this state for approximately 1 ms, i.e. after the duration of the compensation pulse, the data drivers discontinue the supply of +25 V by making all the p-ch transistors, $QX_{pl}$ through $QX_{pm}$, non-conductive while all the n-ch transistors, $QX_{nl}$ through $QX_{nm}$, are made conductive, thus at the time $t_2$ the compensation pulse is ended and the cell voltage becomes +165 V, the pedestal pulse level. For the k+1 th frame cycle, during which the polarity of the cell voltage is reversed, at the time $t_{11}$, +190 V of the DC power source V31 is supplied through the diodes 22 to all the scan electrodes by closing the switch 31-1 (as well as 42-1, but which may not be used, as described for FIG. 10) while all other switches in the driving pulse generators 3' and 4' are kept open. At this time, all the data drivers supply 0 V to all the data electrodes, through the n-ch transistors, $QX_{nl}$ through $QX_{nm}$, while all the p-ch transistors, $QX_{pl}$ through $QX_{pm}$, are non-conductive. Thus, the negative compensation pulse voltage, −190 V, is applied to all the cells. At the time $t_{12}$ approximately 1 ms later than $t_{11}$, all the data electrodes are switched to +25 V, which is the bias voltage of the data pulses for this frame cycle. Thus, at the time $t_{12}$, the compensation pulse is ended, and the cell voltage becomes −165 V, the pedestal pulse level. After the compensation pulse, total scan pulses may be produced by switching the switch 32-1 and 33-1 alternately for the k-th frame cycle, or switching the switch 41-1 and 42-1 alternately for the k+1 th frame cycle. Synchronized with the produced total scan pulses, one of the scan drivers 7-1 through 7-n selectively passes the produced total scan pulses on to the associated scan electrode. The advantage of this circuit configuration is that the cost of the circuit construction is less. While the scan pulses are thus produced and applied to the scan electrodes from either pulse generator 3' or 4' another pulse generator 4' or 3' may be disconnected from the respective terminal 16 or 15 by opening all the switches of the pulse generator to be disconnected. This state is where the terminal is floating.

Figure 12:
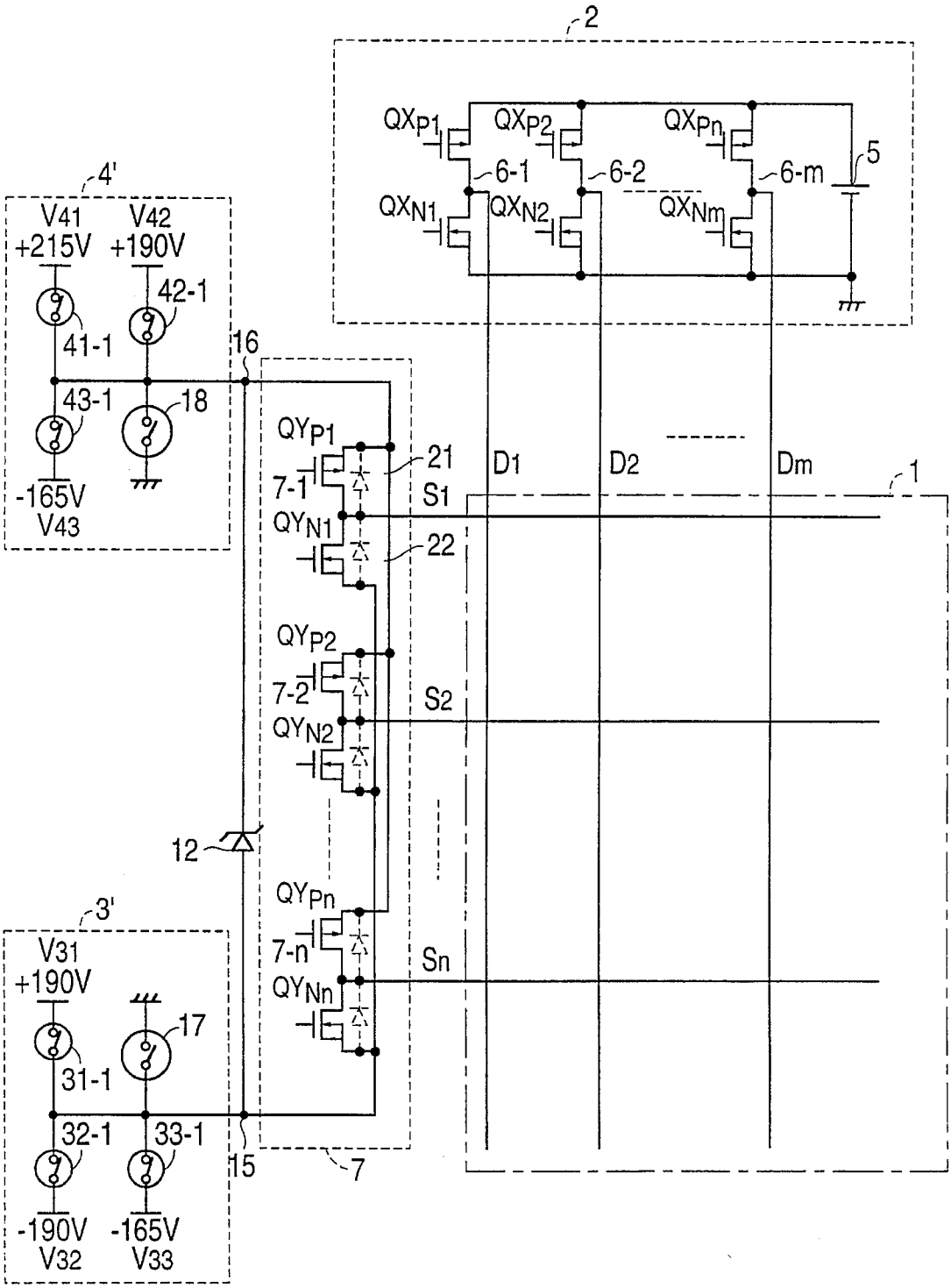
FIG. 12 schematically illustrates another circuit diagram for producing pulses according to the present invention.
Figures 13A, 13B, 13C, 13D:
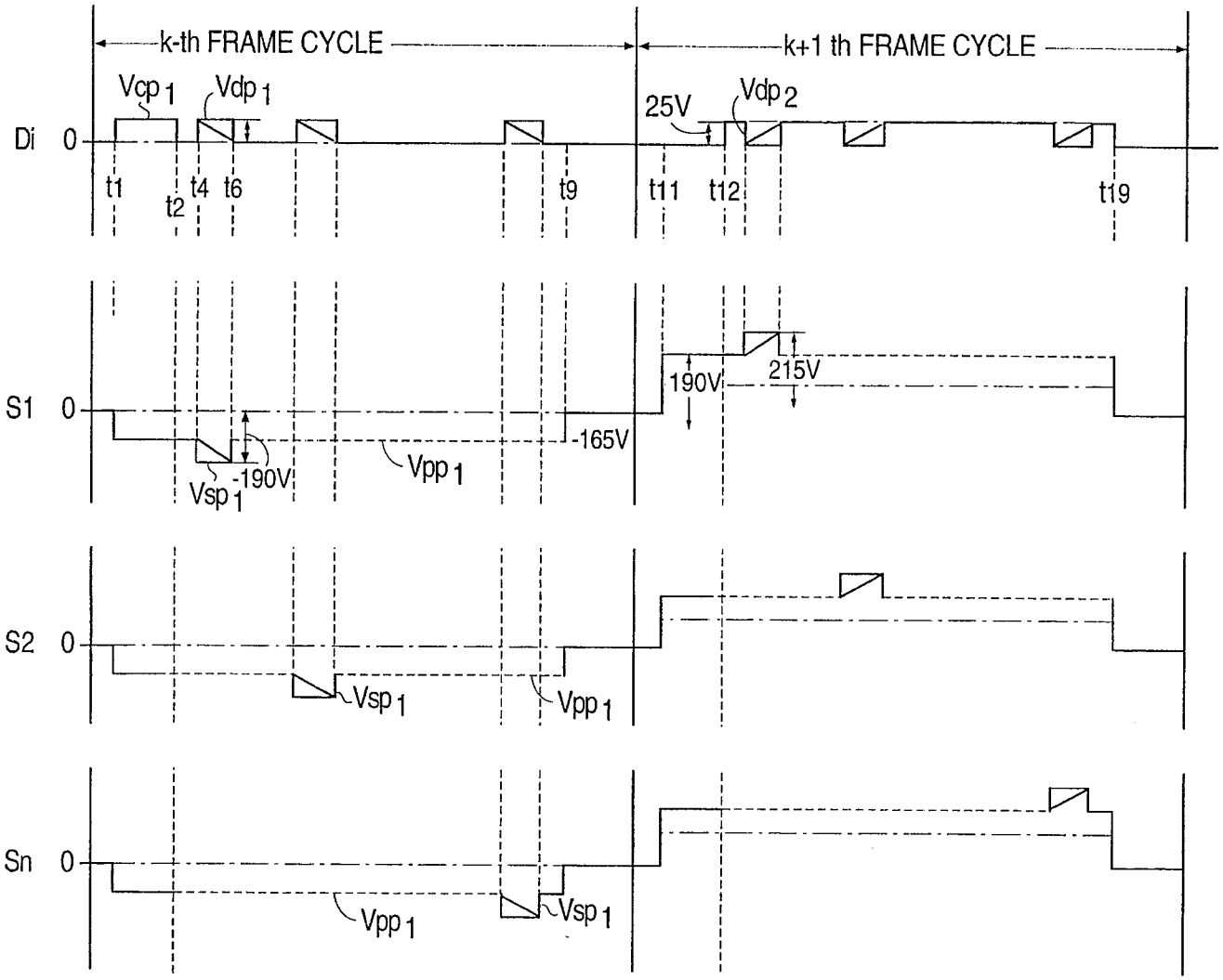
FIG. 13 illustrate timing charts of the applied pulses of the circuit shown in FIG. 12.
Figures 13E, 13F, 13G:
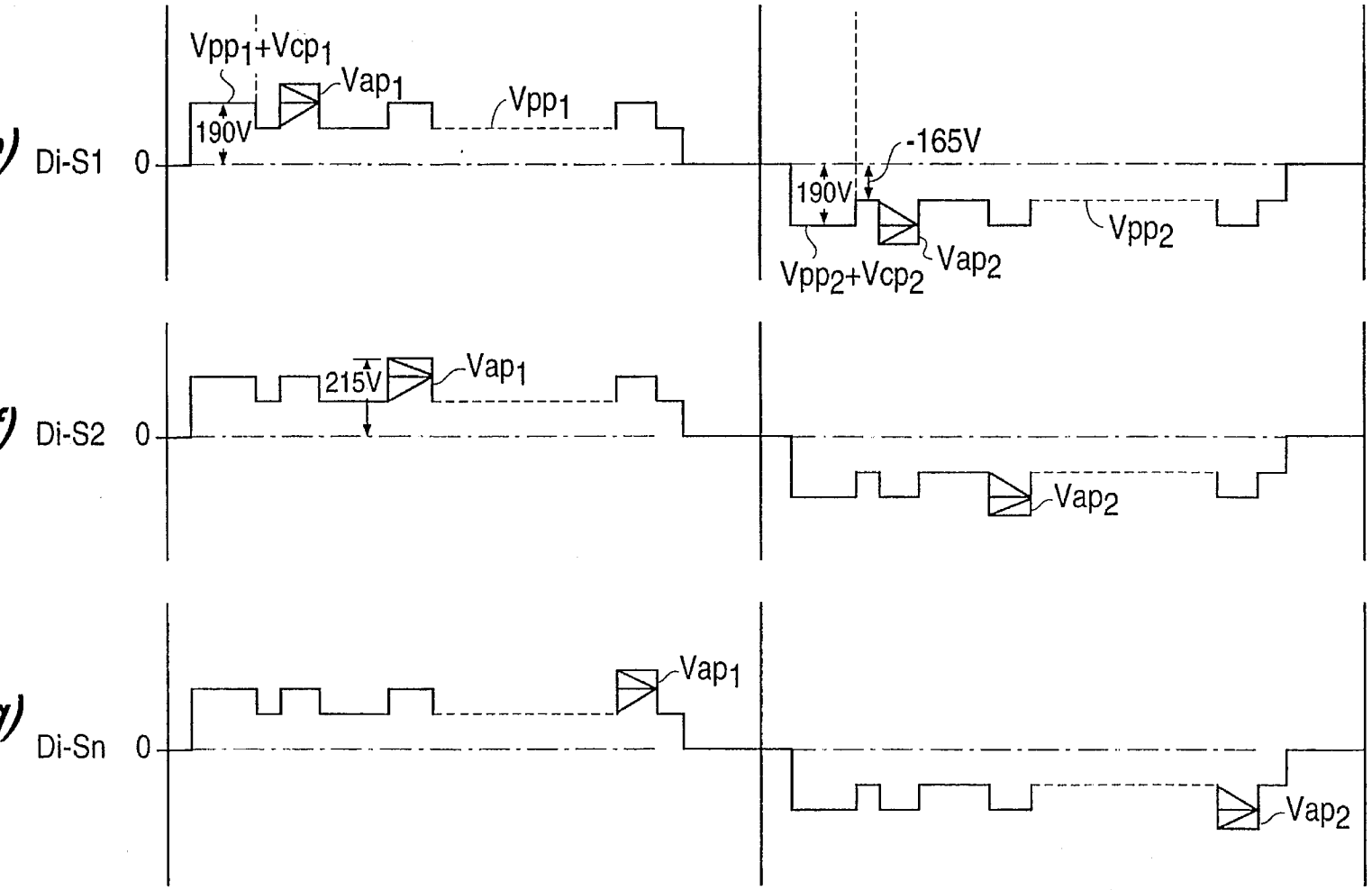
Figure 14:
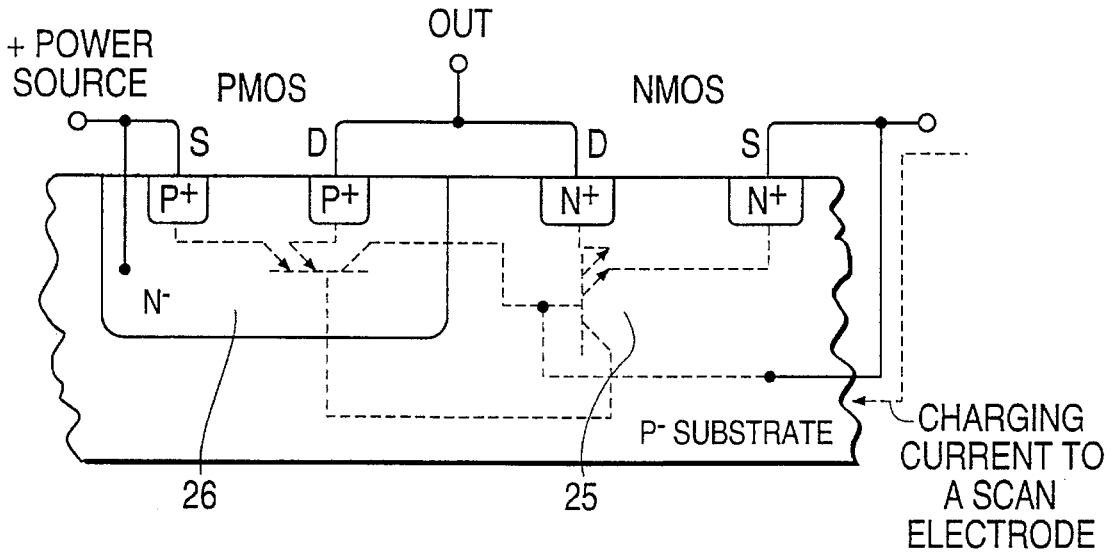
FIG. 14 schematically illustrates the latch-up phenomena taking place in a CMOS driver.

The advantage of the configuration having two sets of power generators 3 and 4 (or 3' and 4') at both power-receiving terminals 15 and 16 for the scan drivers 7 to receive power or pulse as shown in FIGS. 10 and 12 respectively is that a latch-up phenomena taking place in the CMOS scan driver is prevented. As shown in FIG. 14 and as well known, an NPN parasitic transistor 25 and a PNP parasitic transistor 26 are naturally formed in a CMOS structure. When a large pulse, such as the compensation pulse or pedestal pulse, charges or discharges the scan electrodes of the configuration of FIG. 3 of the prior art, the charging/discharging current flowing through the parasitic diode 21 or 22 may be of a considerable amount, and this diode current acts as a base-emitter current of the parasitic transistor 25 or 26, thus both the parasitic transistors 25 and 26 are latched up by the positive feed back, allowing a current to flow from the source electrode of the p-ch MOS transistor to the source electrode of the n-ch MOS transistor through the CMOS structure, resulting in a fatal damage thereof. However, the configuration of FIG. 10 as well as 12 having pulse generators (3, 4, or 3', 4') connected to the both power-receiving terminals 15 and 16 of the push-pull drivers prevents the latch-up phenomena therein, because the voltages of the terminals are equal (if the forward voltage drop of the zener diode is neglected), or one of the terminals is floating. Consequently, this advantage also allows an increase in the reliability of the device as well as the use of an inexpensive IC.

Even though it is described above that the applied pulses are synchronized with each other, in a practical circuit the timing of rising and falling of the applied pulses may intentionally or unintentionally deviate from each other by some degree. Therefore, there is a chance for the transistor of the driver ICs to have higher voltage than 25 V, for example 215 V, applied thereon. In order to protect the driver IC from an unexpected high voltage applied thereto, a zener diode 12 having a zener breakdown voltage lower than the withstanding (breakdown) voltage of the scan driver may be provided between the terminal 15 and 16. The zener breakdown voltage of the zener diode 12 must be of course same to or larger than the normal voltage difference imposed on these transistors, 25 V for this case, but the optimum value of the zener breakdown voltage shall be discussed later on.

Figure 3:
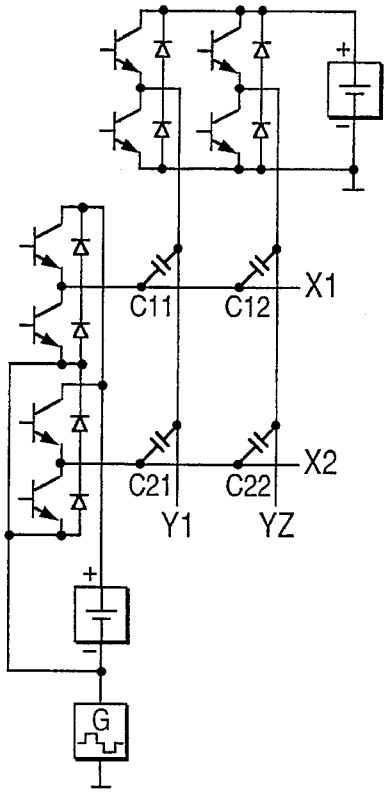
FIG. 3 PRIOR ART
FIG. 3 illustrates a configuration of driving circuits of the prior art.
Figure 4:
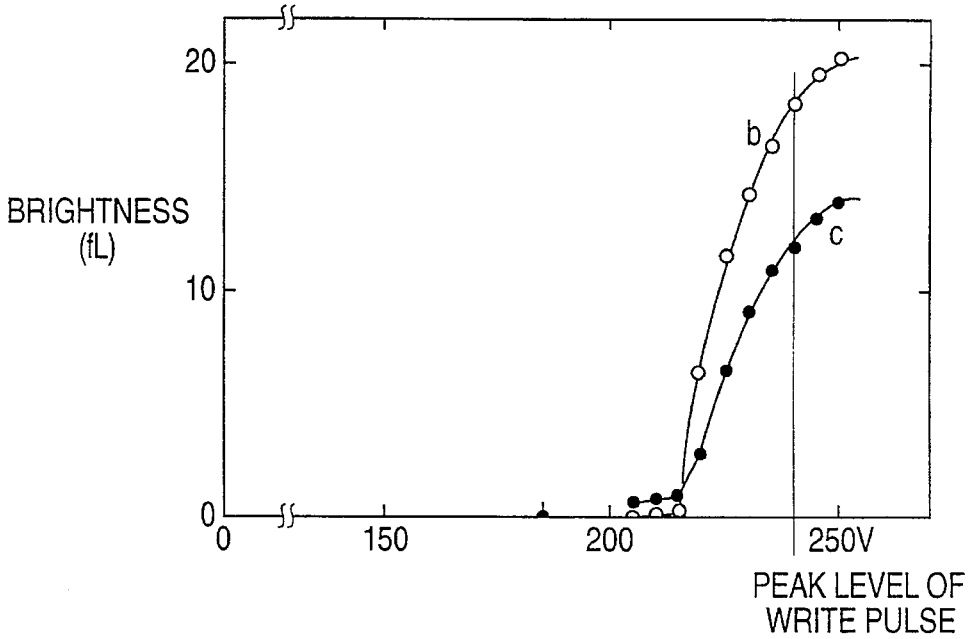
FIG. 4 illustrates the effect of virtual pedestal voltage on the brightness of the lighted cells.
Figure 5:
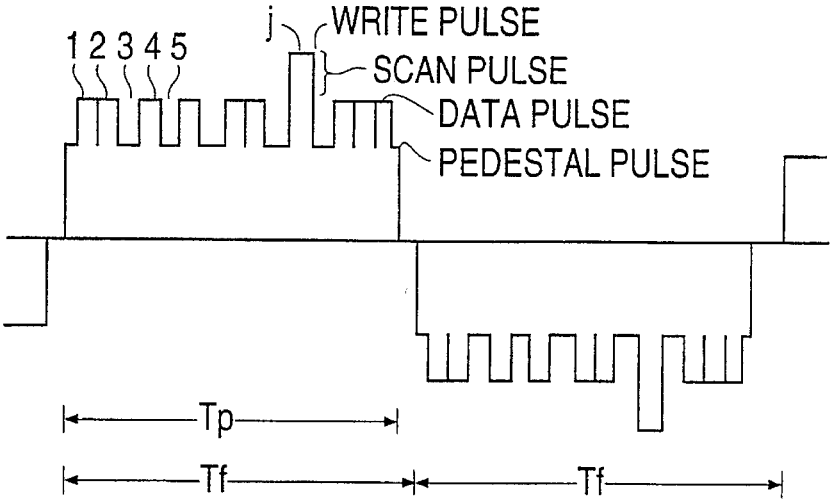
FIG. 5 PRIOR ART
FIG. 5 illustrates a cell voltage waveform according to the prior art.
Figure 15:
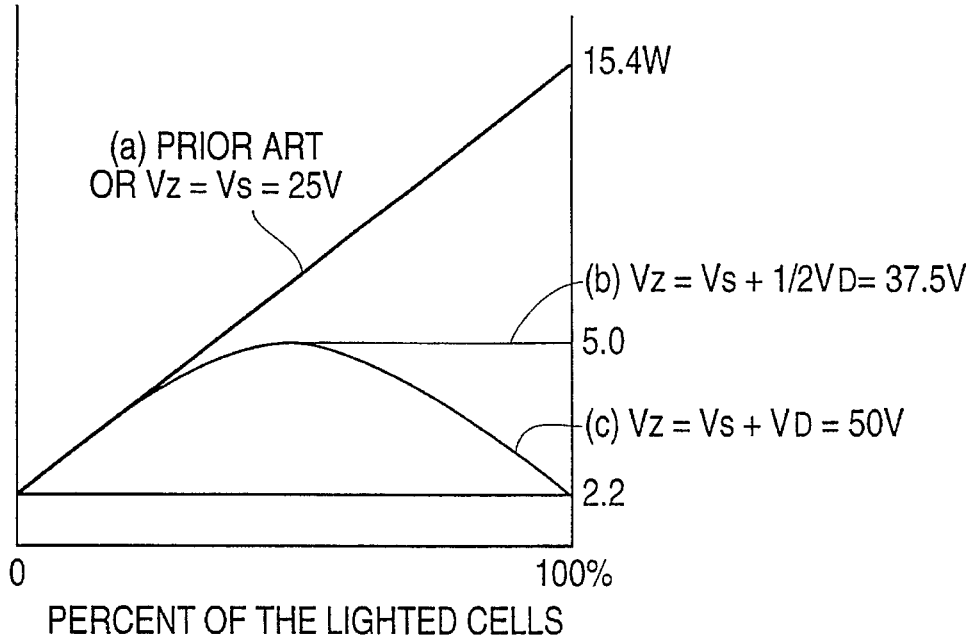
FIG. 15 illustrates power consumption vs. percentage of the lighted cells for various zener voltages.

With the above-described configuration referring to FIG. 12, after the scan electrodes are charged up to the pedestal voltage from the power source V43, the power source V43 may be disconnected by opening the switch 43-1, i.e. the terminal 16 may be floated, then or while the scan pulse is applied from the first pulse generator 3' through the terminal 15. Details of the timing of the applied pulses shall be described later on. As for the next frame cycle having the reversed polarity of pulses, after the scan electrodes are charged up to the pedestal voltage from the power source V31, the power source V31 may be disconnected, i.e. the terminal 15 may be floated, then or while the scan pulse is applied from the second pulse generator 4' through the terminal 16. The purpose of this floating of one power-receiving terminal 15 or 16 is to transmitting the charging current of the data pulses applied to the data electrodes through cells which are on non-selected scan electrodes, but to which the data pulses are applied, so that power consumption is reduced. In other words, when the average potential of all the data electrodes of a scan electrode is changed by the change of the numbers of selected data electrodes according to the displayed pattern, the potential of the scan electrode can quickly change following the average potential of the data electrodes, thus the unnecessary charging current flowing into the non-selective cells can be prevented. The amount of the reduction in power consumption varies depending on the zener voltage of the zener diode 12. The power consumption vs. percentage of the lighted cells for different zener voltages is shown in FIG. 15, where the number of the data electrodes is 640 and the number of the scan electrodes is 400. In the figure, the curve "a" shows the case where the zener voltage is equal to the scan voltage Vs, 25 V. The power consumption of the prior art configuration of FIG. 3 is also given by the curve "a" . When the zener voltage is Vs+Vd/2, 32.5 V, as well as Vs+Vd, 50 V, the power consumption is shown by the curve "b" and "c" respectively. As the zener voltage is increased, the power consumption for more than 50% lighted cells is decreased. This is explained as follows. A positive charging current, for the k-th frame cycle, by positive data pulses from the data driver through the non-lighted cells on non-selected scan electrodes cannot flow to the terminal 16, because these non-selected scan electrodes are floating. This charging current thus flows into other non-lighted cells on the same non-selected scan electrodes but also other data electrodes having no data pulse thereon, so charge flows into these data electrodes, then to the conductive n-ch transistors of the data drivers 6, and returns to the ground terminal of the power source 5. The amplitude of this current is determined by the impedance between the terminals of the data electrodes to which data pulses are applied and the terminals of the data electrodes to which a data pulse is not applied. Therefore, this impedance, which is the series connection of the cells to which data pulses are applied and the cells to which data pulse is not applied, is a minimum, thus the charging current is maximum, where the lighted cells are 50%, then the power consumption is maximum. This means that this charging current decreases as the percent of the lighted cells increases beyond 50%. When the zener voltage is lower than VS+Vd, the scan electrodes are clamped to the zener voltage beyond a particular percentage point, in other words, the terminal 16 is no longer floated due to the conduction of the zener diode, into which the charging current through the non-lighted cells flow while consuming a power therein. When the zener voltage is equal to Vs, the charging current through the non-lighted cells always flows into the zener diode, this state is equivalent to the case where the terminal 16 is not floating (so connected to the power source V43). Thus the power consumption is shown by the curve "a". When the zener voltage is increased, the withstanding voltage of the scan driver must be of course increased. The same phenomena occurs also in the k+1 th frame cycle of the opposite cell voltage. Therefore, the value of the zener voltage is chosen by the design policy for the system, trading off the withstanding voltage of the driver IC to the power consumption.

Although in the above-description the floating of the power-receiving terminal is carried out continuously after the pedestal pulse voltage is applied, there are some types of the timing modes in which terminal floating may be intermittent depending on the pulse widths of the data pulse and the width of the scan pulse and their mutual timing relation. Two typical samples of the timing relations of the data pulses and the scan pulses are shown as timing charts in FIGS. 16 and 17. In the figures, dotted lines of the waveforms of each pulse illustrate that the pulses are floating. Similarly in FIG. 13, the dotted lines of the waveforms illustrate that the pulses are floating. In the case of FIG. 16 where the data pulses are wide enough to be continuous to the adjacent one, the pedestal power source V43 of −165 V connected to the power-receiving terminal 16 of the push-pull driver is disconnected, namely floating, on or before the time $t_3$ when the front edge of the first data pulse is applied to the data electrode. The floating is discontinued at the time $t_9$ when or after the final data pulse is ended. In the case of FIG. 17 where each data pulse is not so long as the adjacent data pulses become continuous, the pedestal power source V43 of −165 V previously connected to the power-receiving terminal 16 is disconnected, namely floating at the time $t_4$ when the front edge of the first data pulse is applied to the data electrode, and connected again at the time $t_6$ when the first data pulse is ended. The floating is thus repeated during every period during which a data pulse is applied to the data electrode. In either case above-mentioned shown in FIGS. 16 and 17, before or at the time when the data pulse is applied to the data electrode, the power-receiving terminal 16 becomes floating. The data pulse is applied to the data electrode approximately 5 μ sec, for example, prior to the application of the scan pulse. This is in order to cover a delay of the data pulse to charge up the cells caused by the electrical resistance of the data electrode which is made of very resistive material, such as ITO having 8 K ohm per electrode. This early application of the data pulse prior to the scan pulse is also disclosed in the U.S. Pat. No. 4,636,789 by H. YAMAGUCHI et al.

Though in the above description of the embodiment of the invention the level of the compensation pulse is 195 V or 190 V, which is higher than the half selective voltage, i.e. "pedestal pulse voltage Vp+data pulse voltage Vd", it may be lower than the half selective voltage, when some deterioration of the brightness uniformity is allowed.

Though in the above description of the embodiment of the invention the compensation pulse as well as the pedestal pulse is supplied through the scan drivers to the cells, these pulses may be supplied through the data drivers.

Although in the above description of the embodiment of the invention the single-ended push-pull drivers of the data drivers as well as the scan drivers are composed of CMOS, they may be composed of other kinds of transistors, for example, pairs of PNP and NPN bipolar transistors, pairs of NPN transistors, pairs of PNP transistors, or similarly p-ch or n-ch MOS transistors. Even though in the above description of the embodiment of the invention the single-ended push-pull drivers of the data drivers as well as the scan drivers are described that when a push-pull driver driver drives its electrode, other push-pull drivers are all switched reversely, in other words, the p-ch transistors are non-conductive as well as the n-ch transistors are conductive, however, both of the paired transistors, i.e. also the n-ch transistors, may be non-conductive.

In the above description of the embodiment of the invention the frame cycle is 60 HZ, it is apparent that the present invention may be applied to also other frame cycles.

In the above description of the embodiment of the invention the applied cell voltage is symmetric, it is apparent that the cell voltage may be asymmetric.

Although in the above description of the embodiment of the invention the scan or data electrodes are driven respectively by a single group of drivers, it is apparent that the drivers may be composed of a plurality of the groups of push-pull drivers, each group having two power-receiving terminals which are connected to respective pulse generators.

Even though in the above description of the embodiment of the invention many power sources and switches are referred to so that the timing of the application of each pulse is understood clearly, these power sources and their associated switches may be unified and simplified as long as the necessary pulse waveforms are obtained the electrodes. Though the switches are illustrated by mechanical switches in the figures, these switches may be of course formed of semiconductor switches.

In the above description of the embodiment of the invention a zener diode is connected between the power-receiving terminals 15 and 16, any other constant-voltage means, such as a varistor, a capacitor or a DC power source, may be employed in place of the zener diode.

In the above description of the embodiment a refresh pulse is not applied in the cells, however, it is apparent that the refresh pulse may be employed to the embodiment of the present invention and enhances the total brightness of the lighted cell through the frame cycle.

The many features and advantages of the invention are apparent from the detailed specification and thus, it is intended by the appended claims to cover all such features and advantages of the system which fall within the true spirit and scope of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What we claim is:

1. A method of driving an electroluminescent display panel of a matrix type in successive frame cycles, the display panel having a plurality of scan electrodes, a plurality of data electrodes arranged orthogonally to and intersecting the scan electrodes and defining cells and electrically luminous material at the cell-defining intersections of the scan electrodes and the data electrodes, said method of driving selectively lighting the cells and comprising the steps of:

applying a pedestal pulse having a polarity and a pedestal voltage level, selectively through the data electrodes or the scan electrodes, to all of the cells in each frame cycle, each pedestal pulse having a duration no greater than that of a frame cycle, the polarity of the pedestal pulse being constant and the pedestal voltage level being substantially fixed during each frame cycle and successive pedestal pulses having respective, alternating polarities in successive frame cycles;

applying a scan pulse, having a polarity and a scan voltage level, to a selected scan electrode and synchronized with the pedestal pulse in a frame cycle, the scan pulse being superposed onto the pedestal pulse voltage level in the case of the pedestal pulse being applied selectively through the scan electrodes to the cells, the polarity of the scan pulse being constant and the scan voltage level thereof being fixed during each frame cycle and successive scan pulses having respective, alternating polarities in successive frame cycles;

applying a data pulse, having a polarity and a data voltage level, to a selected data electrode for selecting and lighting the corresponding cell defined at the intersection of the scan and data electrodes selected in a frame cycle, the data pulse being applied to the selected data electrode in synchronization with the application of the scan pulse to the selected scan electrode, the data pulse being superposed onto the pedestal pulse voltage level in the case of the pedestal pulse being applied selectively through the data electrodes to the cells and, in each frame cycle, the polarity of each data pulse being constant and the voltage level thereof being fixed and, in successive frame cycles, the respective data pulses having alternating polarities;

in each frame cycle, the sum of the pedestal voltage level, the scan voltage level and the data voltage level defining a write pulse voltage of a voltage level sufficient to light each selected cell in that frame cycle, the lighted cell producing a polarization charge and the number of cells associated with a data electrode and lighted in that frame cycle producing a virtual pedestal pulse voltage level which is greater than the fixed pedestal pulse voltage level and which has a maximum value determined by the maximum number of selected and lighted cells associated with that data electrode in the frame cycle, the maximum value producing a corresponding maximum polarization charge; and applying a compensation pulse to all of the cells, in each current frame cycle and in advance of at least the applying of the scan pulse for selecting a first one of the scan electrodes in the current frame cycle, the applied compensation pulse having a polarity which is the same as the polarity of the pedestal pulse applied in the current frame cycle and having a voltage level and duration which are sufficient to generate a polarization charge in each cell which is at least substantially as great as the maximum polarization charge generated by the maximum value of the virtual pedestal pulse voltage level at the cell but which are insufficient to light any cell.

2. A method according to claim 1, wherein said step of applying a compensation pulse includes:

applying the compensation pulse to all of the cells with the voltage level thereof being substantially equal to one of a sum of the pedestal voltage level of the applied pedestal pulse and the data voltage level of the applied data pulse, and a sum of the pedestal voltage level of the applied pedestal pulse and the scan voltage level of the applied scan pulse.

3. A method according to claim 1 or 2, wherein said step of applying a compensation pulse includes:

providing the voltage level of the applied compensation pulse in each frame cycle, selectively to all the scan electrodes or to all the data electrodes.

4. A method according to claim 1 or 2, wherein said step of applying a compensation pulse includes:

providing the compensation pulse to all of the cells, formed by one of a superposition of the voltage level of the applied pedestal pulse and the data voltage level of the applied data pulse, and a superposition of the pedestal voltage level of the applied pedestal pulse and the scan voltage level of the applied scan pulse.

5. A method according to claim 1, wherein said step of applying said compensation pulse further comprises the steps of:

while applying said pedestal pulse having a first pedestal voltage level of a first polarity to all of the data electrodes, applying said scan voltage level of a second polarity opposite to the first polarity to all of the scan electrodes, a sum of the second pedestal voltage level and said scan voltage level acting as a compensation pulse of the first polarity; and while applying said pedestal pulse having a second pedestal voltage level of the second polarity to all of the data electrodes, applying a ground level voltage to all of the scan electrodes in a next frame cycle, said pedestal pulse of said second pedestal voltage level acting as a compensation pulse of the second polarity.

6. A method according to claim 1, wherein said step of applying said compensation pulse further comprises of the steps of:

while applying said pedestal pulse having a first pedestal voltage level of a first polarity to all of the scan electrodes, applying a scan voltage level of the first polarity to all of the scan electrodes and applying a ground level voltage to all of the data electrodes, a sum of said first pedestal voltage level and said scan voltage level acting as a compensation pulse of the second polarity, opposite to the first polarity; and while applying said pedestal pulse having a second pedestal voltage level of the second polarity to all of the scan electrodes, applying the ground level voltage in a next frame cycle to all of the data electrodes, said pedestal pulse having said second pedestal voltage level acting as a compensation pulse of the first polarity.

7. A method of driving an electroluminescent display panel of a matrix type, the display panel having a plurality of scan electrodes, a plurality of data electrodes arranged relatively to the scan electrodes so as to form a matrix of spaced intersections between each of the plurality of data electrodes and each of the plurality of scan electrodes, and electrically luminous material at each intersection of the matrix of spaced intersections thereby to define a corresponding matrix of display cells, said method comprising the steps of:

defining successive frame cycles, each successive frame cycle of a common duration;

defining a pedestal pulse having a fixed pedestal voltage level, a duration less than the frame cycle duration and a fixed polarity in each frame cycle, successive pedestal voltages having respective, alternating polarities in corresponding, successive frame cycles;

defining a succession of scan pulses, respectively corresponding to the plurality of scan electrodes, at respective, spaced time intervals synchronized with the pedestal pulse in each frame cycle, the succession of scan pulses in each frame cycle having a common scan pulse voltage level and a fixed polarity and the successions of scan pulses of the respective, successive frame cycles having alternating polarities;

defining a succession of data pulse time intervals synchronized with the succession of scan pulse time intervals in each frame cycle, a data pulse voltage level which is constant and a data pulse polarity which is fixed in each frame cycle and data pulse polarities which alternate in successive frame cycles;

driving the panel for lighting selected cells thereby to display data on the panel in accordance with, in each frame cycle, applying a pedestal pulse to all cells, selectively through the plurality of scan electrodes or through the plurality of data electrodes, applying corresponding scan pulses, in succession and during the respective scan pulse intervals, to the plurality of respectively corresponding scan electrodes for selecting same, in succession, and applying a data pulse to each data electrode corresponding to a cell defined by the intersection of the data electrode with the selected scan electrode and which is to be lit, thereby to produce, at each cell which is to be lit, a cell voltage comprising the sum of the pedestal voltage level, the scan pulse voltage level and the data pulse voltage level, the lighting of the cell producing a polarization charge at the cell and the number of cells which are commonly associated with a data electrode and which are lighted in a frame cycle producing a virtual pedestal pulse voltage level which is greater than the fixed pedestal pulse voltage level and which has a maximum virtual pedestal pulse voltage level determined in accordance with the maximum number of selected and lighted cells commonly associated with the data electrode in the frame cycle, the maximum value producing a corresponding maximum polarization charge; and applying a compensation pulse to all of the cells, in each frame cycle and in advance of at least the applying of the scan pulse for selecting a first one of the scan electrodes in that frame cycle, the applied compensation pulse having a polarity which is the same as the polarity of the pedestal pulse applied in that common frame cycle and having a voltage level and duration sufficient to generate a polarization charge in each cell which is at least substantially as great as the maximum polarization charge but which is insufficient to light any cell.

8. A method as recited in claim 1 or 7, further comprising:

applying the compensation pulse in advance of the applying of the pedestal pulse.

9. A method as recited in claim 1 or 7, wherein the compensation pulse has a leading edge and a trailing edge and the pedestal pulse has a leading edge and trailing edge, further comprising:

applying the compensation and pedestal pulses in a current frame cycle such that the leading edge of the compensation pulse follows the trailing edge of the pedestal pulse of a preceding frame cycle and such that the leading edge of the pedestal pulse of the current frame cycle occurs no sooner than the trailing edge of the compensation pulse of the current frame cycle.

10. A method as recited in claim 1 or 7, wherein the compensation pulse is formed by simultaneously applying a data pulse and a pedestal pulse, in advance of applying the first scan pulse to a corresponding scan electrode, in each frame cycle.

11. A method as recited in claim 1 or 7, further comprising, in each frame cycle subsequently to applying the compensation pulse and prior to applying a first scan pulse, applying the pedestal pulse for a time duration sufficient to charge all the cells to the pedestal pulse voltage level.

12. A system for driving an electroluminescent display panel of a matrix type having a write pulse voltage of a predetermined level with a first part and a second part and a plurality of scan electrodes intersecting a plurality of data electrodes orthogonally arranged to the scan electrodes, said system comprising:

a cell, formed at an intersection of the scan electrodes and the data electrodes, producing an electrically luminous effect in response to receiving the write pulse voltage of the predetermined level;

first switching elements in first push-pull configurations, operatively connected to corresponding ones of the data electrodes or the scan electrodes, receiving, controlling and providing the first part of the write pulse voltage to the corresponding ones of the data electrodes or the scan electrodes;

power receiving terminals, operatively connected to the display panel, receiving the second part of the write pulse voltage;

second switching elements arranged in second push-pull configurations, each of said second switching elements operatively connected to only one of said power-receiving terminals and each of said second push-pull configurations having an output terminal operatively connected to a corresponding one of the scan electrodes or the data electrodes, each of said second push-pull configurations receiving, controlling and providing the second part of the write pulse voltage to the corresponding one of the scan electrodes or the data electrodes; and first and second pulse generators each being operatively connected to a corresponding one of said power-receiving terminals and providing the second part of the write pulse voltage to said second switching elements, one of said first and second pulse generators operatively disconnecting from the corresponding one of said power-receiving terminals while another one of said first and second pulse generators provides the second part of the write pulse voltage to a cell to be lit via the corresponding connected power receiving terminal and the one of said power-receiving terminals corresponding to the disconnected one of said first and second pulse generators floating.

13. A system according to claim 12, wherein data pulses are applied to said plurality of data electrodes for a duration, said system further comprising:

means for continuously disconnecting said first pulse generator from a first one of said power-receiving terminals during the duration of the applied data pulses, and for continuously disconnecting said second pulse generator from a second one of said power-receiving terminals while said first pulse generator is connected to the first one of said power receiving terminals and during a next duration of the applied data pulses.

14. A system according to claim 12, wherein data pulses are applied to said plurality of data electrodes for a duration, said system further comprising:

means for intermittently disconnecting said first pulse generator from a first one of said power-receiving terminals at least during the duration of the applied data pulses, and intermittently disconnecting said second pulse generator from a second one of said power-receiving terminals at least during a next duration of the applied data pulses while said first pulse generator is connected to the first one of said power receiving terminals.

15. A method according to claim 12, wherein said step of applying a compensation pulse includes:

providing the voltage level of said compensation pulse to the scan electrodes or the data electrodes.

16. A system according to claim 12, further comprising constant-voltage means, operatively connected between said power-receiving terminals, for maintaining a constant voltage between said power-receiving terminals.

17. A method of driving a matrix type electroluminescent display system having a display panel of matrix type in which an electroluminescent cell is formed at each intersection of a plurality of scan electrodes intersecting a plurality of data electrodes orthogonally arranged thereto; a plurality of first switching elements connected to the data electrodes receiving, providing and controlling application of a data pulse voltage onto each of the data electrodes; a pedestal pulse generator, connected to the display panel, generating and providing a pedestal pulse voltage having a first voltage level, to the display panel; a scan pulse generator, connected to the display panel, generating and providing a scan pulse voltage level higher than the first voltage level of said pedestal pulse to the display panel and having a same polarity as the first voltage level of said pedestal pulse; a plurality of second switching elements arranged in a plurality of push-pull configurations, each of said second switching elements operatively connected to the display panel and one of two power-receiving terminals, a first one of the two power-receiving terminals operatively connected to said pedestal pulse generator, and a second one of the two power-receiving terminals operatively connected to said scan pulse generator said method comprising the steps of:

applying said pedestal pulse voltage through each of said push-pull configurations to each of the scan electrodes from said pedestal pulse generator, and charging all of the cells up to the first voltage level of said pedestal pulse generator;

holding the first power-receiving terminal in a floating state;

applying said scan pulse voltage through a selected one of said second switching elements from the second power-receiving terminal to a corresponding one of the scan electrodes;

applying said data pulse voltage through a selected one of said first switching elements to a corresponding one of the data electrodes synchronized with said step of applying said scan pulse voltage, and additionally charging a selected cell from the first voltage level of said pedestal pulse generator up to a second voltage level and producing an electrically luminous effect lighting the cell.

18. A method of driving an electroluminescent display panel in each of successive frame cycles, the panel having a matrix of plural luminescent cells arranged in rows and columns, each cell being disposed at the intersection of a row and a column, for selective lighting by establishing a write voltage across the cell in an initial frame cycle, comprising the steps of:

applying a pedestal pulse having a polarity and a pedestal pulse voltage level, to all the cells during each frame cycle, the polarity of the pedestal pulse being constant during each frame cycle and alternating in successive frame cycles;

applying a scan pulse to each row of cells for individually selecting each row thereof during each frame cycle, each scan pulse having a fixed voltage level and a constant polarity in each frame cycle and the polarity alternating in successive frame cycles in synchronization with the alternating polarity of the pedestal pulses so as to be in additive relationship therewith and produce a half-select pulse at each cell associated with the selected row of cells;

applying a data pulse to each column of cells for selecting each column thereof in which an associated cell is to be selectively lighted, in the frame cycle and in synchronization with the selection of the row associated with each cell to be selectively lighted, each data pulse having a fixed data voltage level and a constant polarity in each frame cycle and being synchronized relatively to the polarity and voltage level of the pedestal pulse so as to be in additive relationship therewith and to form a half-select pulse at each cell associated with the selected column of cells;

the additive relationship of a scan pulse, a data pulse and a pedestal pulse at each cell, disposed at the intersection of a selected row and a selected column, defining a write pulse of a voltage level sufficient to light the corresponding cell and the lighted cell producing a polarization charge at the cell, the number of cells in a column thereof which are simultaneously lighted producing a virtual pedestal pulse voltage level which is greater than the pedestal pulse voltage level of the pedestal pulse and which has a maximum value determined by the maximum number of selected and lighted cells of the column of cells in the frame cycle, the maximum value producing a corresponding maximum polarization charge; and applying a compensation pulse to all of the cells prior to the application thereto of the pedestal pulse, the compensation pulse having a polarity which is the same as the polarity of the pedestal pulse in each frame cycle and having a voltage level which produces a polarization charge which is at least substantially as great as the maximum polarization charge but which is insufficient to light any cell.

19. A method according to claim 18, wherein said step of applying the compensation pulse includes:

inducing a uniform polarization charge in the cells which renders the cells unaffected by any number of half-select pulses applied thereto during a frame cycle.

20. A method according to claim 18, wherein said step of applying a compensation pulse includes:

applying said compensation pulse to all of the cells with the voltage level thereof essentially equal to one of a sum of said pedestal pulse voltage level and the data voltage level of said data pulse and a sum of the pedestal pulse voltage level and the scan voltage level of said applied scan pulse.

21. A method according to claim 20, further comprising:

applying said compensation pulse to all of the cells, the compensation pulse having a duration sufficient for the voltage level thereof to cause a first saturation level of the charge polarization of all of the cells which is greater than the maximum polarization charges of the maximum value of the virtual pedestal pulses but less than a second saturation level of the charge polarization of the lighted cells.

22. A method of driving an electroluminescent display panel having a plurality of scan electrodes, a plurality of data electrodes arranged orthogonally to and intersecting the scan electrodes and defining cells at the intersections, each cell thereby being associated with a respective scan electrode and a respective data electrode, and electrically luminous material at the cell-defining intersections, said method comprising the steps of:

applying a pedestal pulse having a polarity and a predetermined pedestal voltage level, through the data electrodes or the scan electrodes to all of the cells, the polarity of the pedestal pulse being constant during predetermined periods and varying for each of a plurality of frame cycles;

applying a scan pulse, having a polarity and a scan voltage level for selecting one of the scan electrodes, to a selected scan electrode, the scan pulse being superposed onto the pedestal pulse when the pedestal pulse is applied thereto, the polarity of the scan pulse varying for each of the frame cycles;

applying a data pulse, having a data voltage level for selecting a cell on the selected scan electrode, to a corresponding data electrode in synchronization with selecting the selected scan electrode, the data pulse being superposed onto the pedestal pulse when the pedestal pulse is applied thereto;

applying a write pulse voltage to a selected cell the write pulse voltage comprising a sum of the pedestal voltage level, the scan voltage level and the data voltage level, each of the voltages having a same polarity across the selected cell, the write pulse voltage being high enough to light the selected cell, and a polarity of the write pulse voltage varying for each of the frame cycles; and applying a compensation pulse, having a voltage level, to all of the cells prior to applying the scan pulse, and in each of the frame cycles the applied compensation pulse having a same polarity as the polarity of said applied pedestal pulse and varying with the applied pedestal pulse for a next predetermined period having a duration sufficient for the voltage level to induce a polarization charge of all of the cells to a saturated amount at least equal to a maximum polarization charge generated by applying a maximum of the pedestal voltage, the voltage level of the applied compensation pulse being higher than the predetermined first voltage level of the applied pedestal pulse and low enough not to light the cells, wherein the compensation pulse is generated by:

while applying the pedestal pulse having a first pedestal voltage level of a first polarity to all of the scan electrodes, applying the data voltage level having a second polarity opposite to the first polarity of the pedestal pulse to all of the data electrodes, a sum of the first pedestal voltage level across the cells and the data pulse voltage level across the cell acting as the compensation pulse of the second polarity, and while applying the pedestal pulse having a second pedestal voltage level of the second polarity to all of the scan electrodes, further applying a substantially ground level in the next frame cycle to all of the data electrodes, the second pedestal voltage level applied across the cell acting as the compensation pulse of the first polarity.

23. A method of driving an electroluminescent display panel having a plurality of scan electrodes, a plurality of data electrodes arranged orthogonally to and intersecting the scan electrodes and defining cells at the intersections, each cell thereby being associated with a respective scan electrode and a respective data electrode, and electrically luminous material at the cell-defining intersections, the method comprising:

applying a pedestal pulse having a pedestal pulse voltage level, selectively through the data electrodes or the scan electrodes, to all of the cells in each frame cycle, successive pedestal pulses applied in respective, successive frame cycles having respective, alternating polarities;

in each frame cycle, applying a scan pulse having a scan voltage level to a corresponding scan electrode thereby to select the corresponding scan electrode, each scan pulse in each frame cycle having a polarity relative to the pedestal pulse of that frame cycle such that the scan voltage level and the pedestal voltage level are in voltage-additive relationship and produce a half-select voltage at the cells associated with the corresponding, selected scan electrode, scan pulses applied in successive frame cycles having respective, alternating polarities;

in each frame cycle, applying a data pulse having a data voltage level to a corresponding data electrode thereby to select the corresponding data electrode, to each data electrode associated with a cell to be lighted during that frame cycle, the data pulse in each frame cycle having a polarity relative to the pedestal pulse of that frame cycle such that the data voltage level and the pedestal voltage level are in voltage-additive relationship and produce a half-select voltage at the cells associated with the corresponding, selected data electrode, data pulses applied in successive frame cycles having respective, alternating polarities;

in each frame cycle and for each cell at the intersection of associated and selected scan and data electrodes, the sum of the data voltage level, the scan voltage level and the pedestal voltage level defining a write pulse voltage across the cell of a voltage level sufficient to light the cell and produce a polarization charge at the lighted cell resulting in producing a virtual pedestal pulse voltage level on the selected data electrode which is greater than the pedestal voltage level and which is determined by, and corresponds to, the number of lighted cells associated with the selected data electrode; and in advance of selecting a first scan electrode and in each frame cycle, applying, to all of the cells, a compensation pulse having a polarity which is the same as the respective pedestal pulse polarity and having a voltage level and a duration which generate, in each cell, a polarization charge which is substantially as great as the polarization charge produced by the virtual pedestal voltage level at the cell in the current frame cycle, and which are insufficient to light any cell.

24. The method as recited in claim 23, further comprising selecting the compensation pulse voltage level and duration so as to generate a polarization charge, in each cell, of a fixed amount which is at least substantially as great as the maximum polarization charge produced by a maximum number of lightable cells associated with the selected data electrode.

25. The method as recited in claim 23, further comprising selecting the compensation pulse voltage level and duration to be of respective, fixed amounts in each of successive frame cycles.

26. The method as recited in claims 23, wherein the compensation pulse precedes the pedestal pulse in each frame cycle.

27. The method as recited in claim 23, wherein the compensation pulse terminates before the pedestal pulse initiates, in each frame cycle.

28. The method as recited in claim 23, wherein the compensation pulse terminates substantially simultaneously with the initiation of the pedestal pulse, in each frame cycle.

29. The method as recited in claim 23, wherein the compensation pulse is formed in additive relationship with an initial portion of the pedestal pulse.

30. A method of driving an electroluminescent display panel having a plurality of scan electrodes, a plurality of data electrodes arranged orthogonally to and intersecting the scan electrodes and defining cells at the intersections, each cell thereby being associated with a respective scan electrode and a respective data electrode, and electrically luminous material at the cell-defining intersections, the method comprising:

applying a pedestal pulse to all of the cells in each frame cycle, successive pedestal pulses applied in respective, successive frame cycles having respective and alternating, opposite polarities;

in each frame cycle, applying scan pulses of the respective polarity in individual succession to the plurality of scan electrodes for selecting the scan electrodes in individual succession;

in each frame cycle, for each successively selected scan electrode and for the cells respectively associated therewith and selected for lighting, applying data pulses through the associated, and thereby selected, data electrodes to the associated and selected cells, the data, scan, and pedestal pulses having respective voltage levels in additive relationship at each selected cell and the sum thereof comprising a write pulse of a voltage level sufficient to light the cell and produce a polarization charge at the lighted cell, a virtual pedestal pulse voltage level being produced on each data electrode which is greater than the pedestal pulse voltage level and which is determined by, and corresponds to, the number of lighted cells associated with the selected data electrode; and in advance of applying scan pulses in each frame cycle, applying, to all of the cells, a compensation pulse of the respective polarity, the compensation pulse having a voltage level and duration which are sufficient to produce a polarization charge in each cell which is substantially as great as the polarization charge produced in a lighted cell and which are insufficient to light any cell.

31. The method as recited in claim 30, further comprising selecting the compensation pulse voltage level and duration to be of respective, fixed amounts in each of successive frame cycles.

32. The method as recited in claim 30, wherein the compensation pulse precedes the pedestal pulse in each frame cycle.

33. The method as recited in claim 30, wherein the compensation pulse terminates before the pedestal pulse initiates, in each frame cycle.

34. The method as recited in claim 30, wherein the compensation pulse terminates substantially simultaneously with the initiation of the pedestal pulse, in each frame cycle.

35. The method as recited in claim 30, wherein the compensation pulse is formed in additive relationship with an initial portion of the pedestal pulse.

* * * * *

UNITED STATES PATENT AND TRADEMARK OFFICE

CERTIFICATE OF CORRECTION

PATENT NO. : 5,517,207
DATED : May 14, 1996
INVENTOR(S) : Kawada et al.

It is certified that error appears in the above-identified patent and that said Letters Patent is hereby corrected as shown below:

On the Title Page, under "U.S. Patent Documents", the fifth reference, change "Ohby et al." to --Ohba et al. -

Please delete columns 1-21 and substitute columns 1-21 as per attached.

Signed and Sealed this

Twenty-sixth Day of June, 2001

*Attest:*

Nicholas P. Godici

*Attesting Officer*

NICHOLAS P. GODICI
*Acting Director of the United States Patent and Trademark Office*

UNITED STATES PATENT AND TRADEMARK OFFICE

CERTIFICATE OF CORRECTION

PATENT NO. : 5,517,207
DATED : May 14, 1996
INVENTOR(S) : Kawada et al.

It is certified that error appears in the above-identified patent and that said Letters Patent is hereby corrected as shown below:

Title page,
U.S PATENT DOCUMENTS, the fifth references, change "Ohby et al." to -- Ohba et al. --.

Column 1,
Line 8, change "May 9, 1987" to -- June 9, 1987 --.

Column 15,
Line 40, after "to a cell" insert -- , --.

Column 18,
Line 18, after "pedestal pulse" insert -- , --.

Column 21,
Line 18, change "claims 23" to -- claim 23 --.

Signed and Sealed this

Eleventh Day of December, 2001

*Attest:*

Nicholas P. Godici

*Attesting Officer*

NICHOLAS P. GODICI
*Acting Director of the United States Patent and Trademark Office*